US008042980B2

(12) United States Patent
Ookubo et al.

(10) Patent No.: US 8,042,980 B2
(45) Date of Patent: Oct. 25, 2011

(54) VEHICLE HEADLAMP

(75) Inventors: Yasuhiro Ookubo, Isehara (JP); Toshiya Abe, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 146 days.

(21) Appl. No.: 12/641,020

(22) Filed: Dec. 17, 2009

(65) Prior Publication Data

US 2010/0165653 A1 Jul. 1, 2010

(30) Foreign Application Priority Data

Dec. 25, 2008 (JP) ..... 2008-329516

(51) Int. Cl.
*F21V 17/02* (2006.01)

(52) U.S. Cl. ..... 362/512; 362/513; 362/518; 362/538; 362/545

(58) Field of Classification Search ..... 362/370, 362/371, 372, 368, 520, 540
See application file for complete search history.

(56) References Cited

U.S. PATENT DOCUMENTS

| | | | |
|---|---|---|---|
| 7,311,430 | B2 | 12/2007 | Tsukamoto et al. |
| 2007/0086202 | A1 | 4/2007 | Tsukamoto et al. |

FOREIGN PATENT DOCUMENTS

| | | | |
|---|---|---|---|
| DE | 102 04 481 | A1 | 8/2003 |
| DE | 10 2007 006 258 | A1 | 8/2008 |
| FR | 2 758 606 | A1 | 7/1998 |
| JP | 2007-109493 | A | 4/2007 |

*Primary Examiner* — Ali Alavi
(74) *Attorney, Agent, or Firm* — Foley & Lardner LLP

(57) ABSTRACT

A vehicle headlamp is provided with semiconductor-type light sources, lenses, a reflector, light shading members, prism members, and a switching device. When the light shading members are positioned in a first location by means of the switching device, a light distribution pattern LP for low beam, having one or more cutoff lines, is illuminated. In addition, when the prism members are positioned in the first location by means of the switching device, a light distribution pattern HP for high beam is illuminated. As a result, the vehicle headlamp can achieve downsizing, weight reduction, power saving, and cost reduction.

11 Claims, 32 Drawing Sheets

VEHICLE HEADLAMP

CROSS-REFERENCE TO RELATED APPLICATIONS

This application claims priority of Japanese Patent Application No. 2008-329516 filed on Dec. 25, 2008. The contents of this application are incorporated herein by reference in their entirety.

BACKGROUND OF THE INVENTION

1. Field of the Invention

The present invention relates to a vehicle headlamp employing a semiconductor-type light source to illuminate light to a forward direction of a vehicle by switching a light distribution pattern having one or more cutoff lines (light distribution pattern for low beam, light distribution pattern for passing) and a light distribution pattern for high beam (light distribution pattern for cruising).

2. Description of the Related Art

A vehicle headlamp of this type is conventionally known (Japanese Laid-open Patent Application No 2007-109493, for example). Hereinafter, a conventional vehicle headlamp will be described. The conventional vehicle headlamp is made up of: a first light source unit forming a light distribution pattern for low beam; and a second light source unit forming a light distribution pattern for high beam. The first light source unit is a projector-type lamp unit, and is provided with: a light source; an elliptical (convergent) reflector; a shade; and a projecting lens. In addition, the second light source unit is a projector-type lamp unit, and is provided with: a light source; an elliptical (convergent) reflector; and a projecting lens. Hereinafter, functions of the conventional headlamp will be described. When the light source of the first light source unit is lit, the light emitted from the light source is reflected by means of the reflector; a part of the reflected light is cut off by means of the shade; a light distribution pattern having an oblique cutoff line and a horizontal cutoff line, i.e., a light distribution pattern for low beam is formed; and the light distribution pattern for low beam is longitudinally and transversely inverted from the projecting lens, and illuminated (projected) to a forward direction of a vehicle. In addition, when the light source of the second light source unit is lit, the light emitted from the light source is reflected by means of the reflector, and the reflected light, as a light distribution pattern for high beam, is longitudinally and transversely inverted from the projecting lens, and is illuminated (projected) toward the forward direction of the vehicle.

Again, the conventional vehicle headlamp is made of: the first light source unit having the light source, the reflector, a shade, and the projector lens; and the second light source unit having the light source, the reflector, and the projector lens. Thus, the conventional vehicle headlamp requires a large number of components and the second light source unit for a light distribution pattern for high beam, and entails problems concerning downsizing, weight reduction, power saving, and cost reduction, accordingly.

The present invention has been made to solve problems concerning downsizing, weight reduction, power saving, and cost reduction, which could arise due to the fact that the conventional vehicle headlamp requires the second light source unit for a light distribution pattern for high beam.

SUMMARY OF THE INVENTION

A first aspect of the present invention is directed to a vehicle headlamp, comprising:

(i) a semiconductor-type light source having a light emitting chip shaped like a planar rectangle;

(ii) a lens for illuminating a part of light is emitted from the light emitting chip of the semiconductor-type light source toward a forward direction of a vehicle, as a light distribution pattern having one or more cutoff lines;

(iii) a reflector having a reflecting surface for forwardly reflecting the light emitted from the light emitting chip of the semiconductor-type light source, excepting light incident to the lens, as a spot light distribution including a main optical axis of a light distribution pattern for high beam;

(iv) a light shading member which is disposed to be movable between a first location and a second location, for disallowing a part of the light emitted from the light emitting chip of the semiconductor-type light source, to be hindered from being incident to the lens, and for shading light that is out of incidence to the lens from the light emitting chip of the semiconductor-type light source, the light being incident to the reflecting surface, when the light shading member is positioned in the first location;

(v) a prism member which is integrally structured together with the light shading member and is disposed to be movable between the first and second locations replaceably with the light shading member, for disallowing the light that is out of incidence to the lens and is emitted from the light emitting chip of the semiconductor-type light source, to be hindered from being incident to the reflecting surface, when the prism member is positioned in the first location, and for allowing a part of the light emitted from the light emitting chip of the semiconductor-type light source, to be incident to the lens in a state in which a reference focal point of the lens is virtually moved; and (vi) a switching device for replaceably switching the light shading member and the prism member that are integrally structured with each other, between the first location and the second location, thereby switching a current light distribution pattern to a respective one of a light distribution pattern having one or more cutoff lines and a light distribution pattern for high beam.

A second aspect of the present invention is directed to the vehicle headlamp according to the first aspect, wherein:

a center of the light emitting chip is positioned at or near a reference focal point of the lens and is positioned on or near a reference axis of the lens;

a light emitting surface of the light emitting chip is oriented in a forward direction of the reference axis of the lens;

a long side of the light emitting chip is parallel to a horizontal axis orthogonal to the reference axis of the lens or is tilted with respect to the horizontal axis;

an incidence surface of the lens is made of a conical curved face;

an emission surface of the lens is made of a free curved face controlled to be curved so that: a projection image of the light source, which is emitted from the emission face of the lens, is disallowed to protrude from the cutoff line on a screen light distribution of the light distribution pattern; and a part of the projection image of the light source is substantially in contact with the cutoff lines;

the free curved face of the emission surface of the lens is made of a free curved face on which: with the reference axis of the lens serving as an origin in a front view, a first quadrant, a second quadrant, a third quadrant, and a fourth quadrant, divided by a vertical axis and a horizontal axis orthogonal to each other, passing through the origin, are defined; and in a case where the first quadrant and the second quadrant are compared with each other in a symmetrical position relationship with respect to the vertical axis, a portion of about ⅓ or more of the first quadrant is higher than the second quadrant in the forward direction of the reference axis of the lens, and in a case where the first quadrant and the forth quadrant are compared with each other in a symmetrical position relationship with respect to the horizontal axis, the portion of about ⅓ or more of the first quadrant is lower than the fourth quadrant in the forward direction of the reference axis of the lens;

the emission surface of the prism member is made of a conical curved face;

the incidence surface of the prism member is made of a free curved face controlled to be curved so as to virtually move the reference focal point of the lens to an upside or an oblique upside; and the free curved face of the incidence surface of the prism member has a convex portion which is convexly curved toward the semiconductor-type light source and a peak of the convex portion is present at a portion spreading across the first quadrant and the second quadrant or at a portion of the first quadrant, in a case where, with the reference axis of the lens serving as an origin in a rear view, the first quadrant, the second quadrant, the third quadrant, and the fourth quadrant, divided by the vertical axis and the horizontal axis orthogonal to each other, passing through the origin, are defined.

A third aspect of the present invention is directed to the vehicle headlamp according to the first aspect, wherein:

the semiconductor-type light source, the lens, the light shading member, and the prism member comprise:

a semiconductor-type light source, a lens, a light shading member, and a prism member for spot light distribution, which serve to implement spot light distribution at a substantially central portion on a screen light distribution of the light distribution pattern having the cutoff lines and the light distribution pattern for high beam; and a semiconductor-type light source, a lens, a light shading member, and a prism member for diffused light distribution, which serve to implement diffused light distribution of an entire portion on the screen light distribution of the light distribution pattern having the cutoff lines and the light distribution pattern for high beam.

A fourth aspect of the present invention is directed to the vehicle headlamp according to the third aspect, wherein:

the cutoff lines are made of: an oblique cutoff line with an upward gradient from an elbow point to a cruising lane side; an upper horizontal cutoff line which is horizontal from the oblique cutoff line to the cruising lane side; and a lower horizontal cutoff line which is horizontal from the elbow point to an opposite lane side;

a long side of the light source of the semiconductor-type light source for spot light distribution is rotated by about 5 degrees, and is tilted with respect to the horizontal axis so that the cruising lane side is upward than the opposite lane side with respect to the horizontal axis around the reference axis of the lens;

a long side of the light source of the semiconductor-type light source for diffused light distribution is parallel to the horizontal axis;

a projection image of the light source, which is emitted from the first quadrant and the fourth quadrant of the emission surface of a respective one of the lens for spot light distribution and the lens for diffused light distribution, mainly forms a light distribution on the cruising lane side from the elbow point on the screen light distribution of the light distribution pattern having the cutoff lines; and a projection image of the light source, which is emitted from the second quadrant and the third quadrant of the emission surface of a respective one of the lens for spot light distribution and the lens for diffused light distribution, mainly form a light distribution on the opposite lane side from the elbow point on the screen light distribution of the light distribution pattern having the cutoff lines.

A fifth aspect of the present invention is directed to the vehicle headlamp according to the first aspect, wherein:

the prism member comprises:

a prism member for high beam, forming the light distribution pattern for high beam; and other one or more prism members for light distribution pattern, forming other one or more light distribution patterns, and the switching device is a switching device for replaceably switching the light shading member and the prism member for high beam, which is integrally structured, and such other one or more prism members for light distribution pattern, between a first location and a second location, thereby switching a current light distribution pattern to a light distribution pattern having one or more cutoff lines, a light distribution pattern for high beam, or alternatively, other one or more light distribution patterns.

A sixth aspect of the present invention is directed to a vehicle headlamp, comprising:

(i) a light source;

(ii) a lens for illuminating a part of light emitted from the light source toward a forward direction of a vehicle, as a light distribution pattern having one or more cutoff lines;

(iii) a reflector for reflecting the light emitted from the light source, the light being out of incidence to the lens, to the forward direction of the vehicle, as a light distribution of a light distribution pattern for high beam;

(iv) a light shading member which is constituted to be movable between a first location in which the light shading member is disposed between the light source and the lens and a second location in which the light distribution member is not disposed therebetween; and (v) a prism member which is disposed to be movable between the first location and the second location replaceably with the light shading member, wherein:

when the light shading member is positioned in the first location, the light shading member allows a part of the light emitted from the light source to be incident to the lens, and shades light that is out of incidence to the lens from the light source, the light being incident to the reflector, whereby the light incident to the lens is illuminated to the forward direction of the vehicle, as the light distribution pattern having the cutoff lines; and when the prism member is positioned in the first location, the prism member is adapted to illuminate toward the forward direction of the vehicle:

the light obtained by allowing the part of the light emitted from the light source to be incident to the lens in a state in which a reference focal point of the lens is virtually moved by means of the prism member; and the light obtained by allowing the light that is out of incidence to the lens from the light source to be reflected by means of reflector, as a light distribution of the light distribution pattern for high beam.

A seventh aspect of the present invention is directed to the vehicle headlamp according to the sixth aspect, further comprising a switching device for replaceably switching the light shading member and the prism member between the first location and the second location, wherein:

the light emitted from the light source is switched to a respective one of a light distribution of the light distribution pattern having the cutoff lines and a light distribution of the light distribution pattern for high beam, in response to an operation of the switching device switching the light shading member and the prism member to be disposed in the first location, and the switched light is illuminated to the forward direction of the vehicle.

An eighth aspect of the present invention is directed to the vehicle headlamp according to the sixth aspect, wherein:

a center of the light source is positioned at or near a reference focal point of the lens and is positioned on or near a reference axis of the lens;

a light emitting surface of the light source is oriented in a forward direction of the reference axis;

a long side of the source is parallel to a horizontal axis orthogonal to the reference axis of the lens or is tilted with respect to the horizontal axis;

an incidence surface of the lens is made of a conical curved face;

an emission surface of the lens is made of a free curved face controlled to be curved so that: a projection image of the light source, which is emitted from the emission face of the lens, is disallowed to protrude from the cutoff line on a screen light distribution of the light distribution pattern; and a part of the projection image of the light source is substantially in contact with the cutoff lines;

the free curved face of the emission surface of the lens is made of a free curved face on which: with the reference axis of the lens serving as an origin in a front view, a first quadrant, a second quadrant, a third quadrant, and a fourth quadrant, divided by a vertical axis and a horizontal axis orthogonal to each other, passing through the origin, are defined; and in a case where the first quadrant and the second quadrant are compared with each other in a symmetrical position relationship with respect to the vertical axis, a portion of about ⅓ or more of the first quadrant is higher than the second quadrant in the forward direction of the reference axis of the lens, and in a case where the first quadrant and the forth quadrant are compared with each other in a symmetrical position relationship with respect to the horizontal axis, the portion of about ⅓ or more of the first quadrant is lower than the fourth quadrant in the forward direction of the reference axis of the lens;

the emission surface of the prism member is made of a conical curved face;

the incidence surface of the prism member is made of a free curved face controlled to be curved so as to virtually move the reference focal point of the lens to an upside or an oblique upside; and the free curved face of the incidence surface of the prism member has a convex portion which is convexly curved toward the semiconductor-type light source and a peak of the convex portion is present at a portion spreading across the first quadrant and the second quadrant or at a portion of the first quadrant, in a case where, with the reference axis of the lens serving as an origin in a rear view, the first quadrant, the second quadrant, the third quadrant, and the fourth quadrant, divided by the vertical axis and the horizontal axis orthogonal to each other, passing through the origin, are defined.

A ninth aspect of the present invention is directed to the vehicle headlamp according to the sixth aspect, wherein:

the semiconductor-type light source, the lens, the light shading member, and the prism member comprise:

a semiconductor-type light source, a lens, a light shading member, and a prism member for spot light distribution, which serve to implement spot light distribution at a substantially central portion on a screen light distribution of the light distribution pattern having the cutoff lines and the light distribution pattern for high beam; and a semiconductor-type light source, a lens, a light shading member, and a prism member for diffused light distribution, which serve to implement diffused light distribution of an entire portion on the screen light distribution of the light distribution pattern having the cutoff lines and the light distribution pattern for high beam.

A tenth aspect of the present invention is directed to the vehicle headlamp according to the ninth aspect, wherein:

the cutoff lines are made of: an oblique cutoff line with an upward gradient from an elbow point to a cruising lane side; an upper horizontal cutoff line which is horizontal from the oblique cutoff line to the cruising lane side; and a lower horizontal cutoff line which is horizontal from the elbow point to an opposite lane side;

a long side of the light source of the semiconductor-type light source for spot light distribution is rotated by about 5 degrees, and is tilted with respect to the horizontal axis, so that the cruising lane side is upward than the opposite lane side with respect to the horizontal axis around the reference axis of the lens;

the long side of the light source of the semiconductor-type light source for diffused light distribution is parallel to the horizontal axis;

a projection image of the light source, which is emitted from the first quadrant and the fourth quadrant of the emission surface of a respective one of the lens for spot light distribution and the lens for diffused light distribution, forms a light distribution on the cruising lane side from the elbow point on the screen light distribution of the light distribution pattern having the cutoff lines; and a projection image of the light source, which is emitted from the second quadrant and the third quadrant of the emission surface of a respective one of the lens for spot light distribution and the lens for diffused light distribution, forms a light distribution on the opposite lane side from the elbow point on the screen light distribution of the light distribution pattern having the cutoff lines.

An eleventh aspect of the present invention is directed to the vehicle headlamp according to the sixth aspect, wherein:

the prism member comprises:

a prism member for high beam, forming the light distribution pattern for high beam; and other one or more prism members for light distribution pattern, forming other one or more light distribution patterns, and the switching device is for replaceably switching the light shading member and the prism member for high beam, which is integrally structured, and such other one or more prism members for light distribution pattern, between a first location and a second location, thereby switching a current light distribution pattern to a light distribution pattern having one or more cutoff lines, a light distribution pattern for high beam, or alternatively, other one or more light distribution patterns.

In the vehicle headlamp according to the first aspect of the present invention, by means for solving the above-described problem, when the light shading members have been replaceably positioned in the first location and the prism members have been replaceably positioned in the second location by means of the switching device, if the light emitting chips of the semiconductor-type light sources are illuminated to emit light, a part of the light beams radiated from the light emitting chips passes through the lenses and is illuminated toward the forward direction of the vehicle, as a light distribution pattern for low beam, having the cutoff lines. At this time, the light that is out of lens incidence from the light emitting chips of the semiconductor-type light sources, the light being to be incident to the reflecting surface of the reflector, is shaded by means of the light shading members. In addition, when the prism members have been replaceably positioned in the first location and the light shading members have been replaceably positioned in the second location by means of the switching device, if the light emitting chips of the semiconductor-type light sources are illuminated to emit light, a part of the light beams radiated from the light emitting chips is illuminated toward the forward direction of the vehicle, as a light distribution pattern for high beam, after passing through the prism members and the lenses in a state in which the reference focal points have been virtually moved to the virtual reference focal points by means of the prism members. At this time, the light that is out of lens incidence from the light emitting chips of the semiconductor-type light sources is incident to, and is reflected on, the reflecting surface of the reflector, without being hindered with the prism members, and illuminates the forward direction of the vehicle as the spot light distribution including a main optical axis of a light distribution pattern for high beam. In this manner, the vehicle headlamp of the first aspect of the present invention employs the semiconductor-type light sources as light sources, and allows a light distribution pattern for low beam, having the cutoff lines, and a light distribution pattern for high beam, to be replaceably illuminated to the forward direction of the vehicle.

In addition, the vehicle headlamp according to the first aspect of the present invention is made of: the semiconductor-type light sources; the lenses; the reflector; the light shading members and prism members that are integrally structured with each other; and the switching device. Thus, a need for a second light source unit for a light distribution pattern for high beam is eliminated, and the number of components is reduced, in comparison with the conventional vehicle headlamp, and downsizing, weight reduction, and cost reduction can be achieved accordingly.

Moreover, the vehicle headlamp according to the first aspect of the present invention allows the reference focal points of the lenses to be virtually moved to the virtual reference focal points by means of the prism members, so that the light distribution pattern emitted from the lenses can be reliably switched from the light distribution pattern for low beam, having the cutoff lines, to the light distribution pattern for high beam. Further, the vehicle headlamp of the first aspect of the present invention allows the spot light distribution including the main optical axis of the light distribution pattern for high beam, to be obtained by means of the reflecting surface of the reflector, so that the light distribution pattern for high beam, having the sufficient maximum luminous intensity, is obtained.

In addition, in the vehicle headlamp according to the second aspect of the present invention, by means for solving the above-described problem, when the light shading members are positioned in the first location, while light beams radiated from the light emitting chips of the semiconductor-type light sources is incident from the incidence surfaces of the lenses and is emitted from the emission surfaces of the lenses, projection images of the light emitting chips, which are substantially in contact with the cutoff lines, are emitted so as not to be convexly curved in an upward direction from the cutoff lines on the screen light distribution of the light distribution pattern for low beam, having the cutoff lines, so that the light distribution pattern for low beam, having the cutoff lines, can be reliably obtained. In addition, in the vehicle headlamp of the second aspect of the present invention, when the prism members are positioned in the first location, the reference focal points of the lenses virtually move to the virtual reference focal points in the upside or right oblique upside direction, so that a portion in high luminous intensity zone of the light distribution pattern for low beam, having the cutoff lines, moves in the upside or right oblique upside direction, and becomes a portion in high luminous intensity zone of the light distribution pattern for high beam; and a portion of the cutoff lines of the light distribution pattern for low beam moves smoothly widely in the upside or right oblique upside direction, and becomes an upside portion of the light distribution pattern for high beam. In this manner, the vehicle headlamp of the second aspect of the present invention becomes capable of replaceably obtaining a light distribution pattern for low beam, having good cutoff lines, and a good light distribution pattern for high beam.

Moreover, the vehicle headlamp according to the second aspect of the present invention allows the light distribution pattern for low beam, having the cutoff lines, to be obtained by means of the semiconductor-type light sources and the lenses that have been fixed, so that there does not vary a portion in high luminous intensity in the vicinity of the cutoff lines of the light distribution pattern for low beam, having the cutoff lines, i.e., an important portion (point). In addition, the spot light distribution, including the main optical axis of the light distribution pattern for high beam, is obtained by means of the semiconductor-type light sources and the reflecting surface of the reflector, which have been fixed, so that there does not vary a portion of the spot light distribution, including the main optical axis of the light distribution pattern for high beam, i.e., an important portion (point). In this manner, the vehicle headlamp of the second aspect of the present invention allows desired light distribution characteristics to be obtained as per a light distribution design.

Further, the vehicle headlamp according to the third aspect of the present invention is suitable to obtain the light distribution pattern for low beam, having the cutoff lines and the light distribution pattern for high beam, because a light distribution pattern, in which the luminous intensity (illumination intensity, amount of light) of a central portion is the highest and the luminous intensity (illumination intensity, amount of light) becomes gradually lowered from the central portion to a peripheral portion, is obtained by means for solving the above-described problem. Moreover, the vehicle headlamp of the third aspect of the present invention allows functions of the semiconductor-type light sources, lenses, light shading members, and prism members to be shared by: the semiconductor-type light source, the lens, the light shading member, and the prism member having a spot light distribution function; and the semiconductor-type light source, the lens, the light shading member, and the prism member, having a diffused light distribution, respectively, and thus, even if light emission outputs of the semiconductor-type light sources are small, it is possible to obtain: a light distribution pattern for low beam, having luminous intensity (illumination intensity, amount of light) of sufficient light distribution patterns (the light distribution pattern, having the cutoff lines, and the light distribution pattern for high beam), in particular a spot light distribution of luminous intensity (illumination intensity, amount of light) which is sufficient at the central portion of the light distribution patterns (the light distribution pattern, having the cutoff lines, and the light distribution pattern for high beam).

Furthermore, the vehicle headlamp according to the fourth aspect of the present invention is suitable to obtain a light distribution pattern having one or more cutoff lines (Z cutoff lines) combined of: the upper horizontal cutoff line at the cruising lane side; the oblique cutoff line at the cruising lane side; and the lower horizontal cutoff line at the opposite lane side, for example, the light distribution pattern for low beam, by means for solving the above-described problem. Moreover, in the vehicle headlamp of the fourth aspect of the present invention, the long side of the light emitting chip of the semiconductor-type light source for spot light distribution is tilted with respect to the X-axis serving as a horizontal axis and the long side of the light emitting chip of the semiconductor-type light source for diffused light distribution is parallel to the X-axis serving as a horizontal axis, so that the spot light distribution can be taken along the oblique cutoff line and the diffused light distribution can be taken along the upper horizontal cutoff line and the lower horizontal cutoff line, making it possible to reliably obtain the light distribution pattern having the Z cutoff lines, for example, the light distribution pattern for low beam.

Still furthermore, in the vehicle headlamp according to the fifth aspect of the present invention, by means for solving the above-described problem, a semiconductor-type light source is employed as a light source, and a light distribution pattern having one or more cutoff lines, a light distribution pattern for high beam, and other one or more light distribution patterns can be switched and illuminated to a forward direction of a vehicle.

DESCRIPTION OF THE PREFERRED EMBODIMENTS

Figure 1:
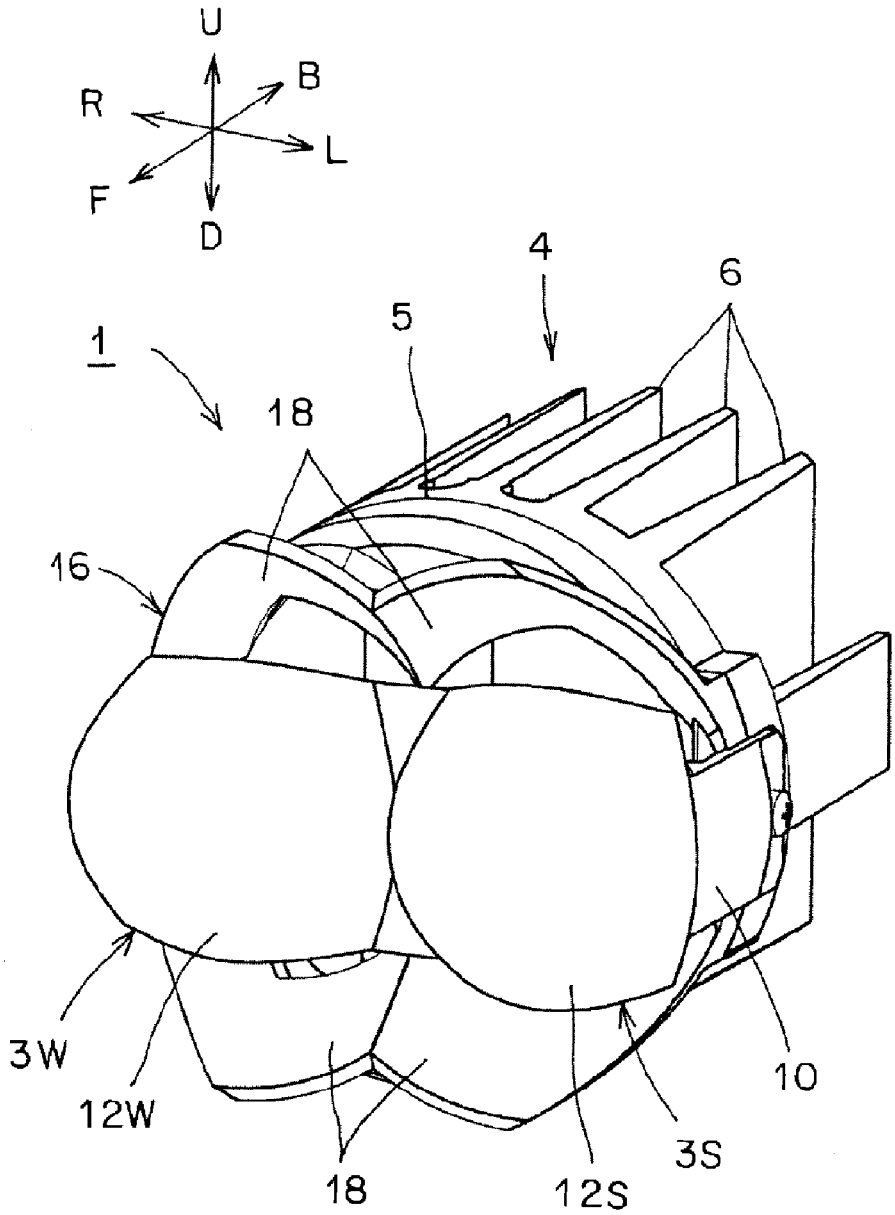
FIG. 1 is a perspective view of the essential parts showing a first embodiment of a vehicle headlamp according to the present invention.

Hereinafter, two embodiments of a vehicle headlamp according to the present invention will be described in detail referring to the drawings. The present invention is not limited by these embodiments. In the drawings, letter sign "VU-VD" designates a vertical line of a top and a bottom of a screen; and the letter sign "HL-HR" designates a horizontal line of a left and a right of the screen. FIGS. 12 to 17A-E are explanatory views showing a projection image (an emission image) or a projection image group (an emission image group) of a light emitting chip on the screen obtained by computer simulation. In the specification and claims, the terms "top", "bottom", "front", "rear", "left", and "right" designate the top, bottom, front, rear, left, and right of a vehicle when the vehicle headlamp according to the present invention is mounted on a vehicle (automobile). In FIGS. 6 to 9, hatching is not shown for the sake of clear explanation.

First Embodiment

FIGS. 1 to 35 show a first embodiment of a vehicle headlamp according to the present invention. Hereinafter, a constitution of the vehicle headlamp of the first embodiment will be described. In the figures, reference numeral 1 designates a vehicle headlamp (automobile headlamp) of the first embodiment. The vehicle headlamp 1 is a vehicle headlamp for left-side cruising lane. A vehicle headlamp for right-side cruising lane is reversed at the left and right in the vehicle headlamp 1 for left-side cruising lane. In addition, in FIG. 2, the X, Y, and Z axes constitute an orthogonal coordinate system (X-Y-Z orthogonal coordinate system). The X axis corresponds to a horizontal axis in a transverse direction and an opposite lane side. In other words, in the first embodiment, the right side R corresponds to a positive direction and the left side L corresponds to a negative direction. In addition, the Y axis corresponds to a vertical axis in a longitudinal direction, and in the first embodiment, the upside U corresponds to a positive direction and the downside D corresponds to a negative direction. Further, the Z axis corresponds to an axis in a forward/backward direction which is orthogonal to the X axis and the Y axis, and in the first embodiment, the foreside F corresponds to a positive direction, and the backside B corresponds to a negative direction.

Figure 32:
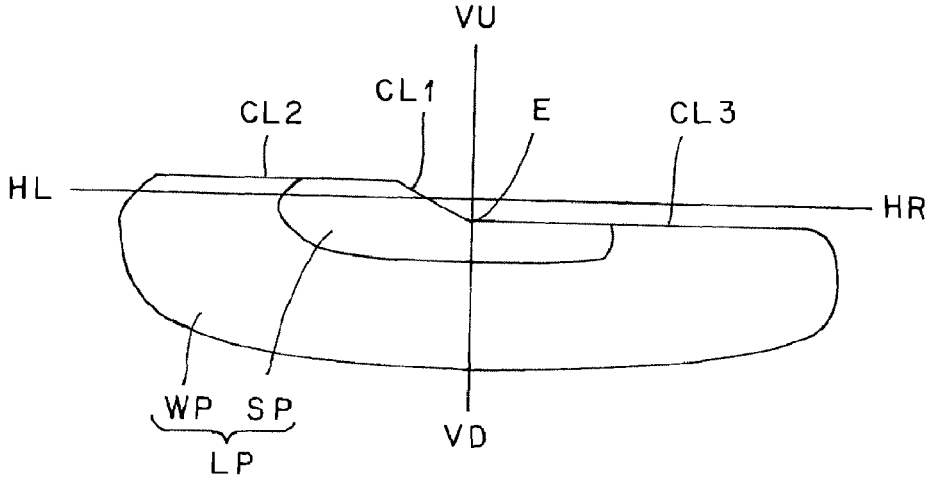
FIG. 32 is an explanatory view showing a light distribution pattern for low beam, which is obtained by combining the spot light distribution of FIG. 16 and the diffused light distribution of FIG. 17, similarly.
Figure 35:
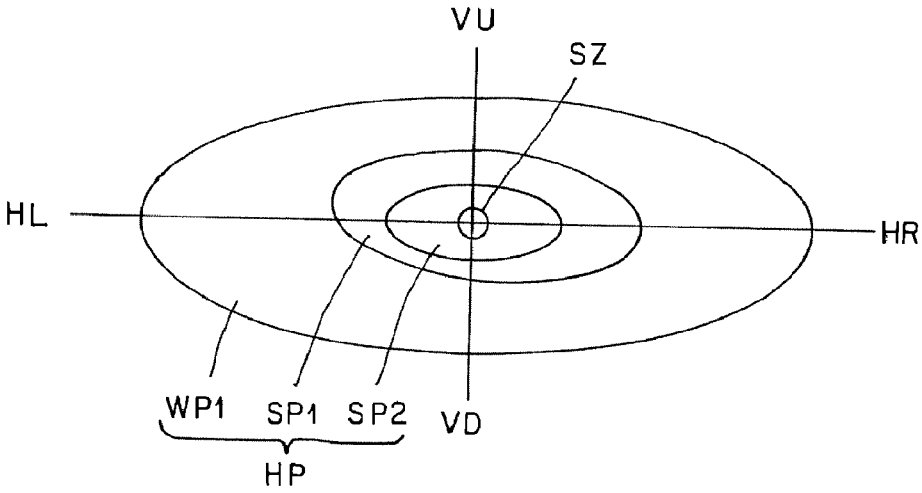
FIG. 35 is an explanatory view showing a light distribution pattern for high beam, which is obtained when the prism member is positioned in the first location, similarly.

The vehicle headlamp 1 is intended to illuminate a light distribution pattern having one or more cutoff lines, shown in FIG. 32, and a light distribution pattern for high beam (light distribution pattern for cruising) HP, shown in FIG. 35, toward a forward direction of a vehicle (not shown). The light distribution pattern having the cutoff lines, shown in FIG. 32, is a light distribution pattern having one or more cutoff lines (Z cutoff lines) made of: an oblique cutoff line CL1 of an upward gradient from an elbow point E toward a cruising lane (left-side); an upward horizontal cutoff line CL2 which is horizontal from the oblique cutoff line CL1 toward a cruising lane side; and a lower horizontal cutoff line CL3 which is horizontal from the elbow point E to an opposite lane side (right side), for example, a light distribution pattern for low beam (light distribution pattern for passing) LP. An angle formed between the oblique cutoff line CL1 and a horizontal line HL-HR of a screen is about 15 degrees. In addition, the elbow point E is on an upside-downside vertical line VU-VD; is more downward than a left-right horizontal line HL-HR; and is a crossing point between the oblique cutoff line CL1 and the lower horizontal cutoff line CL3.

Figure 2:
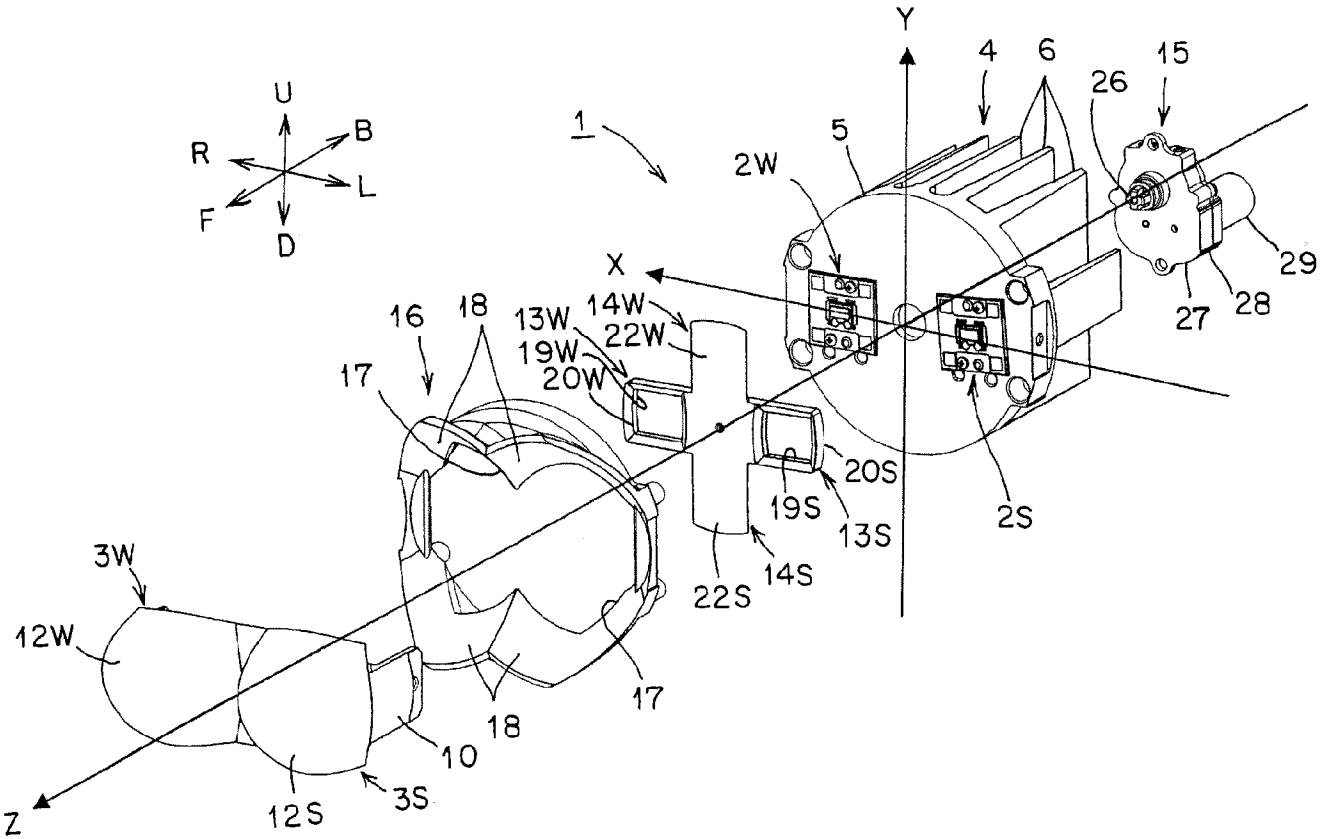
FIG. 2 is an exploded perspective view showing the essential parts, similarly.

The vehicle headlamp 1, as shown in FIG. 2, is made up of: a semiconductor-type light source 2S, a lens 3S, a light shading member 13S, and a prism member 14S for spot light distribution; a semiconductor-type light source 2W, a lens 3W, a light shading member 13W, and a prism member 14W for diffused light distribution; a heat sink member 4; a switching device 15; a reflector 16; and a lamp housing and a lamp lens, although not shown (such as a transparent outer lens, for example).

The heat sink member 4 is made up of: a disk-shaped front portion 5 having a circular fixing face on a foreface (front face); and a rear portion 6 shaped like a fin from an intermediate portion to a rear portion. The heat sink member 4 is made up of a resin member or a metal member with a high thermal conductivity, for example.

The semiconductor-type light source 2S for spot light distribution and the semiconductor-type light source 2W for diffused light distribution (hereinafter, simply referred to as "semiconductor-type light sources 2S, 2W) are fixed, respectively, at the left and right of an intermediate portion in a vertical direction of a fixing face of the front portion 5 of the heat sink member 4. On the other hand, the lens 3S for spot light distribution and the lens 3W for diffused light distribution (hereinafter, simply referred to as "lenses 3S, 3W") are constituted integrally with each other; are disposed at a foreside F of the semiconductor-type light sources 2S, 2W; and are fixed to a side face of the front portion 5 of the heat sink member 4.

Figure 22:
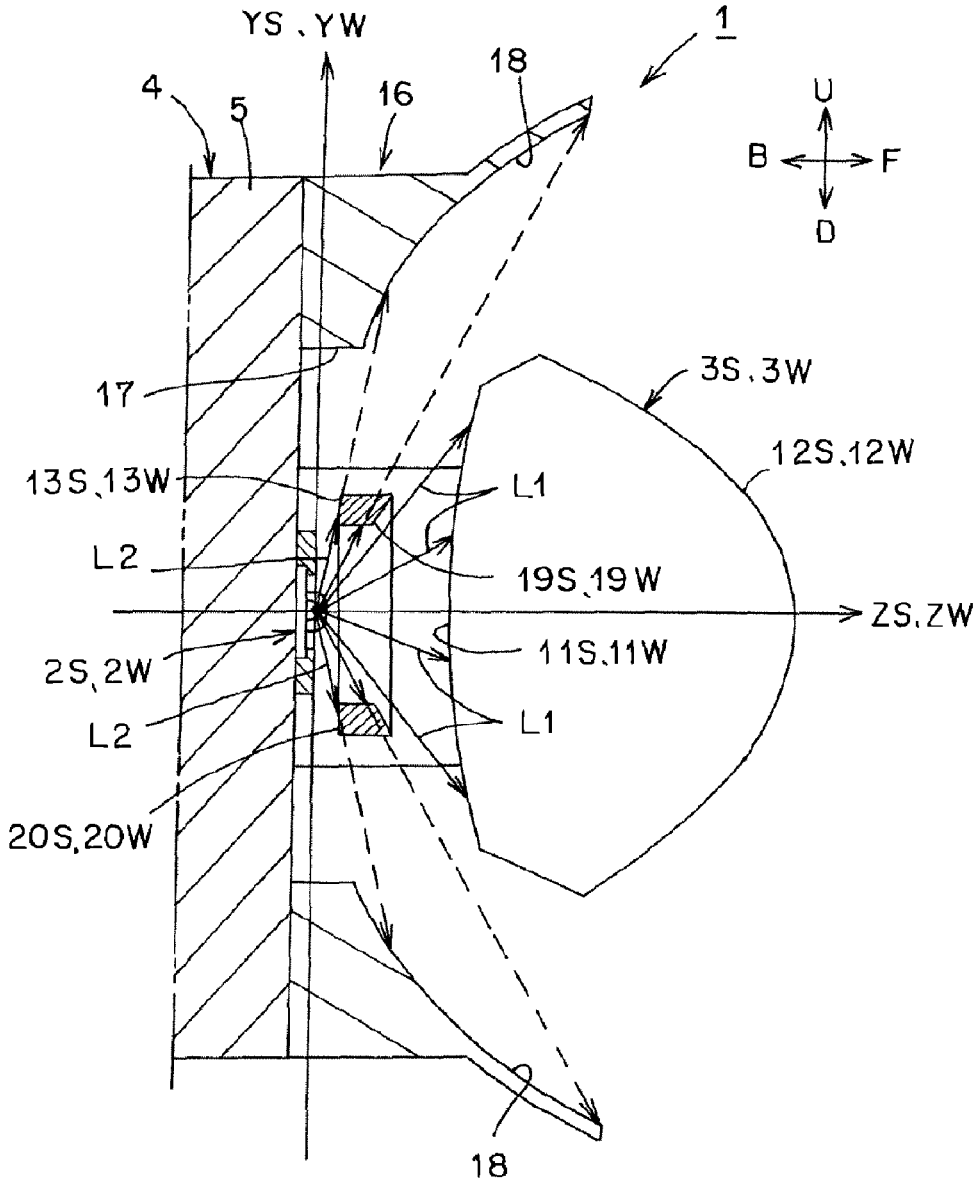
FIG. 22 is an explanatory view showing an optical path when the light shading member is positioned in the first location, similarly.
Figure 23:
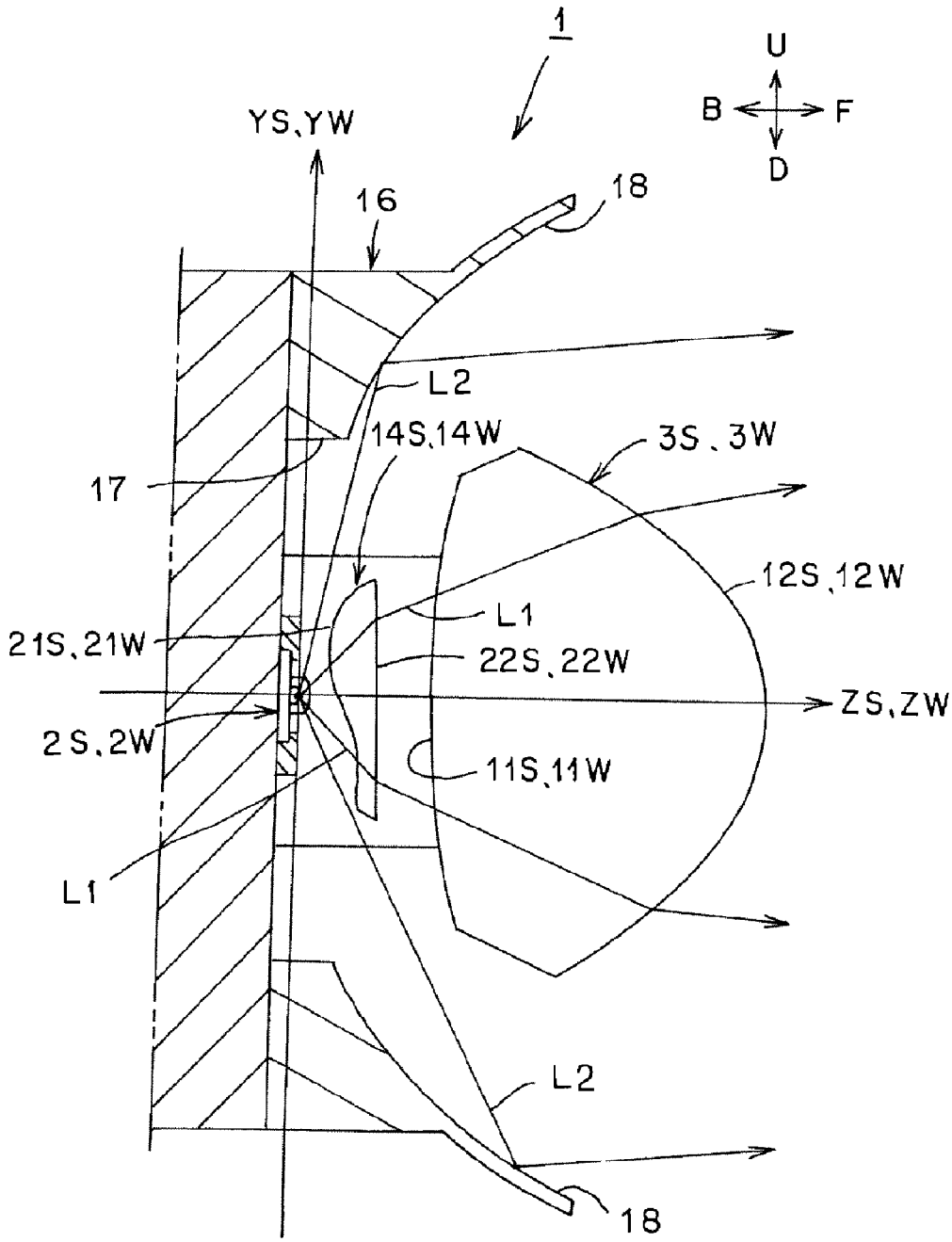
FIG. 23 is an explanatory view showing an optical path when the prism member is positioned in the first location, similarly.
Figure 24:
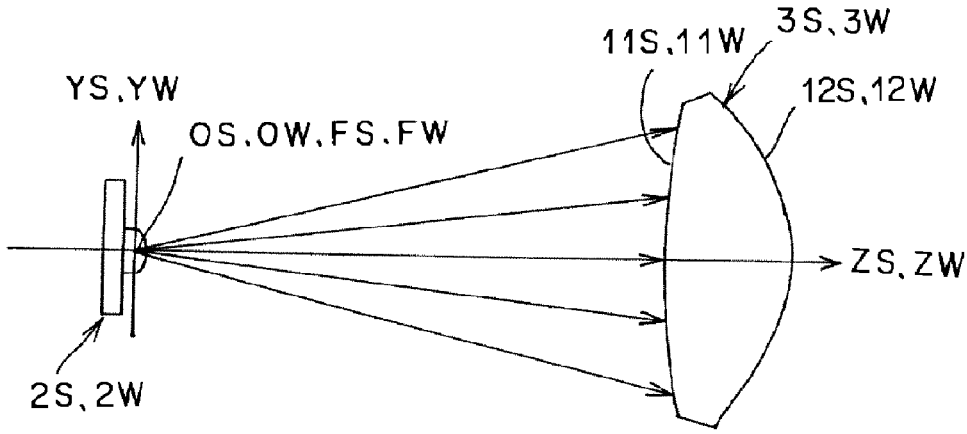
FIG. 24 is an explanatory view showing an optical path when a lens reference focal point is positioned at a center of the light emitting chip, similarly.

The reflector 16 is disposed so as to cover the semiconductor-type light sources 2S, 2W and the lenses 3S, 3W from the outside; and is fixed to a peripheral portion of the fixing face of the front portion 5 of the heat sink member 4. In addition, the switching device 15 is fixed to a face opposite to the fixing face of the front portion 5 of the heat sink member 4. Further, the light shading member 13S and prism member 14S for spot light distribution and the light shading member 13W and prism member 14W for diffused light distribution are integrally constituted in a crossing shape, and are disposed so as to be replaceably positioned between a first location and a second location by the switching device 15. The first location, as shown in FIGS. 22 and 23, is a location between the semiconductor-type light sources 2S, 2W and the lenses 3S, 3W, and the second location is a location which is rotated by 90 degrees around the Z-axis with respect to the first location.

The semiconductor-type light source 2S, lens 3S, light shading member 13S, and prism member 14S for spot light distribution; the semiconductor-type light source 2W, lens 3W, light shading member 13W, and prism 14W for diffused light distribution; the heat ink member 4; the switching device 15; and the reflector 16 constitute lamp units. The lamp units 2S, 3S, 13S, 14S, 2W, 3W, 13W, 14W, 4, 15, 16 are disposed to be optical-axis adjustable vertically around the horizontal axis and horizontally around the vertical axis via an optical axis adjustment mechanism, for example, in a lamp room partitioned by the lamp housing and the lamp lens. In the lamp room, there may be disposed another lamp unit such as a fog lamp, a cornering lamp, a clearance lamp, or a turn signal lamp, other than the lamp units 2S, 3S, 13S, 14S, 2W, 3W, 13W, 14W, 4, 15, 16.

The semiconductor-type light source 2S, lens 3S, light shading member 13S, prism member 14S for spot light distribution have a function of forming spot light distributions SP and SP1 of a substantially central portion on a screen light distribution of a light distribution pattern LP for low beam, having cutoff lines CL1, CL2, CL3, shown in FIG. 32, and a light distribution pattern HP for high beam, shown in FIG. 35. In addition, the semiconductor-type light source 2W, lens 3W, light shading member 13W, and prism member 14W for diffused light distribution have a function of forming diffused light distributions WP and WP1 of an entire portion on the screen light distribution of the light distribution pattern LP for low beam, having the cutoff lines CL1, CL2, CL3, shown in FIG. 32, and the light distribution pattern HP for high beam, shown in FIG. 35.

Figure 3:
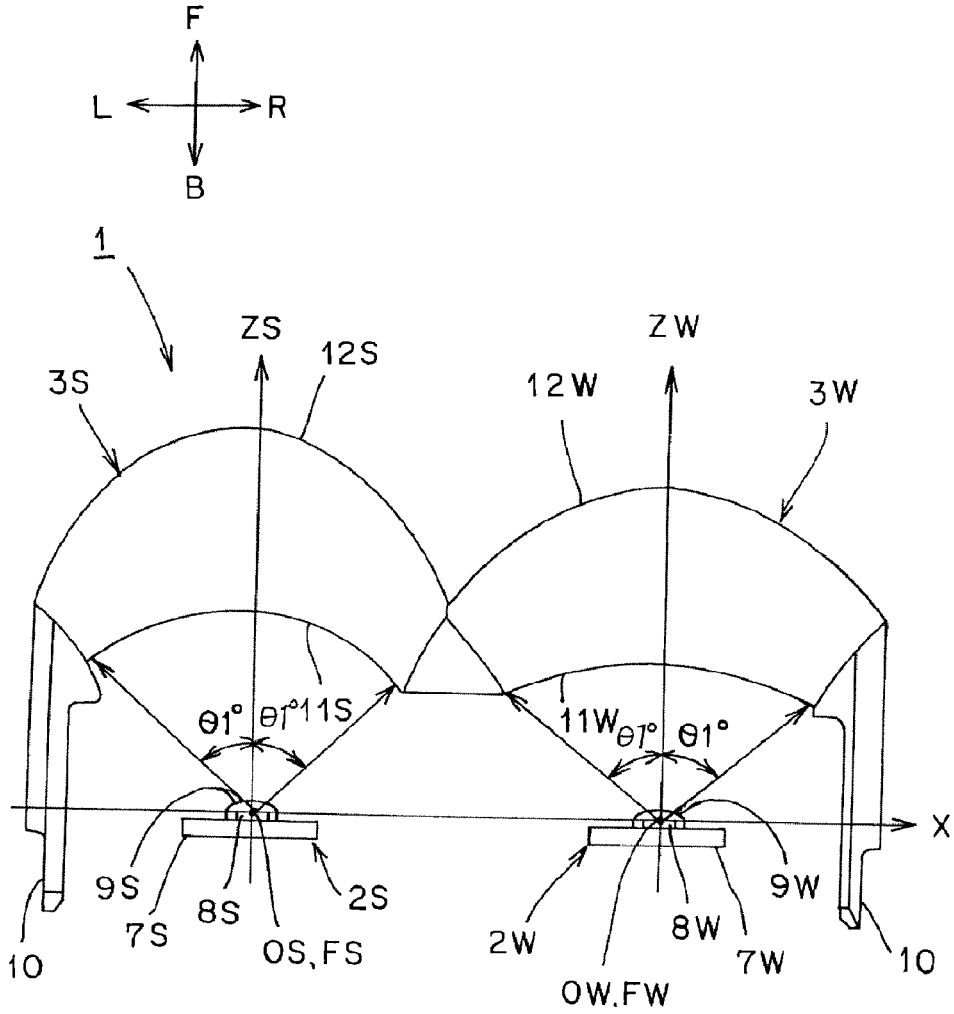
FIG. 3 is a plan view showing a semiconductor-type light source and a lens for spot light distribution and a semiconductor-type light source and a lens for diffused light distribution, similarly.
Figure 4:
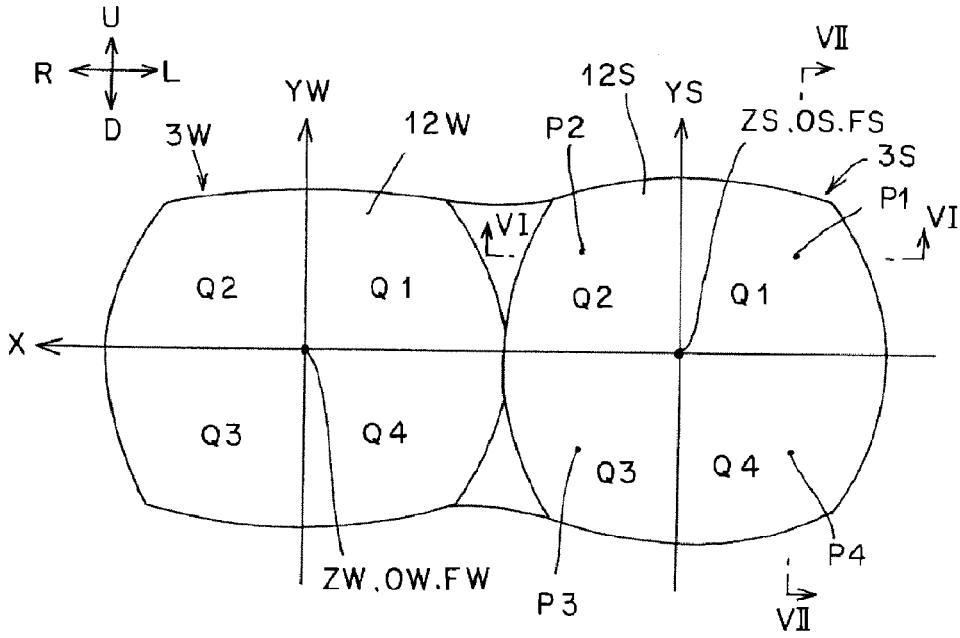
FIG. 4 is a front view showing the lens for spot light distribution and the lens for diffused light distribution, similarly.
Figure 5:
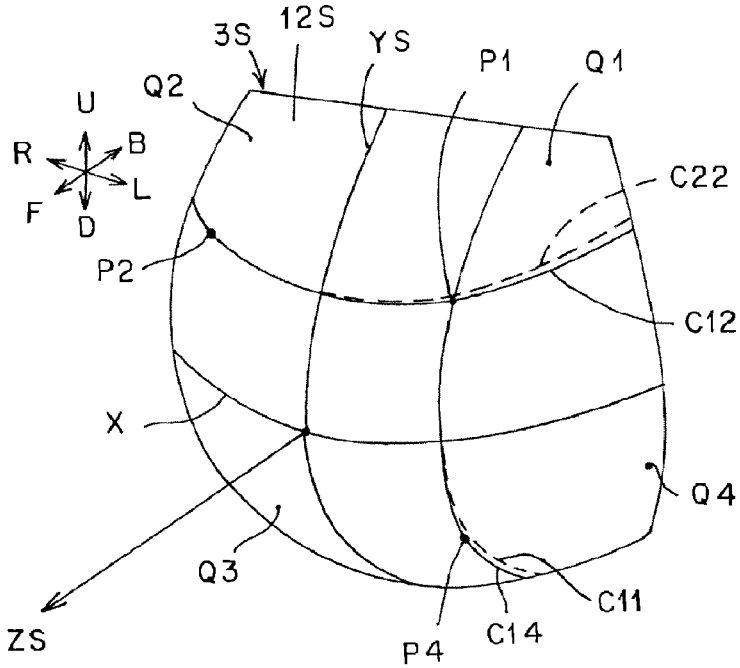
FIG. 5 is a perspective view showing the lens for spot light distribution, similarly.

The semiconductor-type light sources 2S, 2W, as shown in FIG. 3, are made up of: boards 7S, 7W; light emitting chips 8S, 8W which are provided on the board 7S, 7W; and a sealing resin members (lens members) 9S, 9W shaped like a thin rectangular prism, for sealing the light emitting chips 8S, 8W, respectively. Surfaces of the sealing resin members 9S, 9W are formed to be convex-curved faces, respectively. The semiconductor-type light sources 2S, 2W are fixed, respectively to the fixing face of the front portion 5 of the heat sink member 4 via a holder or a fixing frame. In FIG. 3, the light shading members 13S, 13W and the prism members 14S, 14W are not shown for the sake of clear explanation.

Figure 10A:
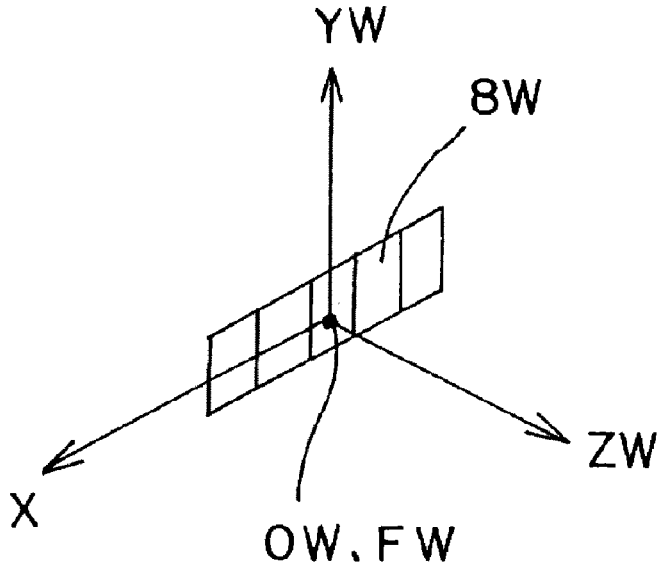
FIGS. 10A and 10B are explanatory views, each of which shows a light emitting chip of the semiconductor-type light source for diffused light distribution, similarly.
Figure 10B:
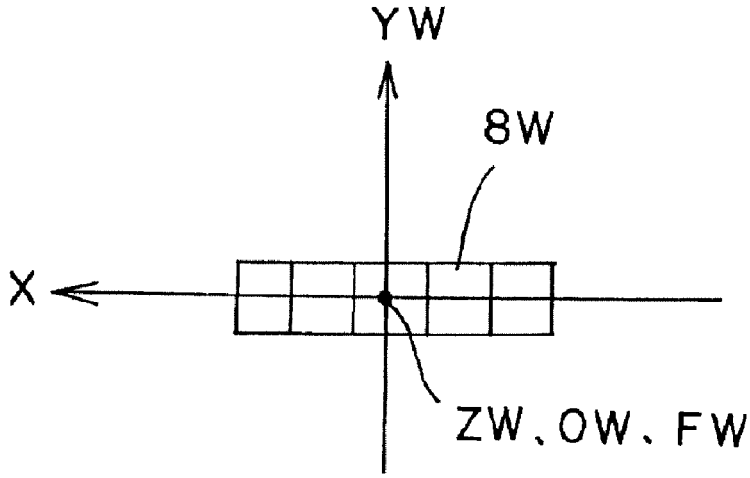
Figure 11A:
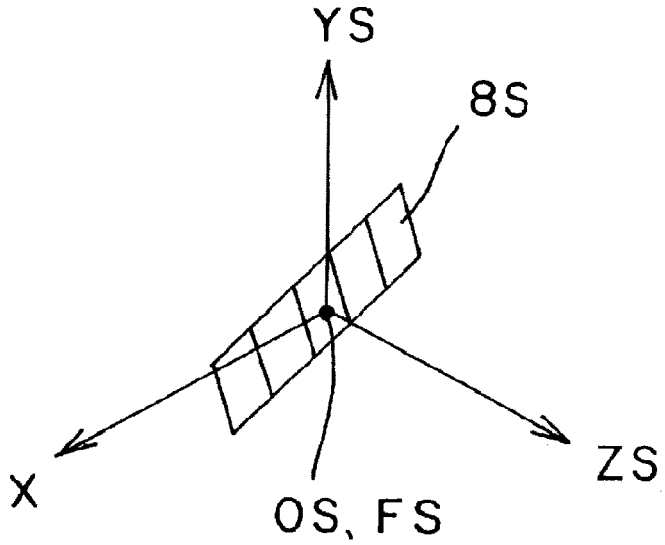
FIGS. 11A and 11B are explanatory views, each of which shows a light emitting chip of the semiconductor-type light source for spot light distribution, similarly.
Figure 11B:
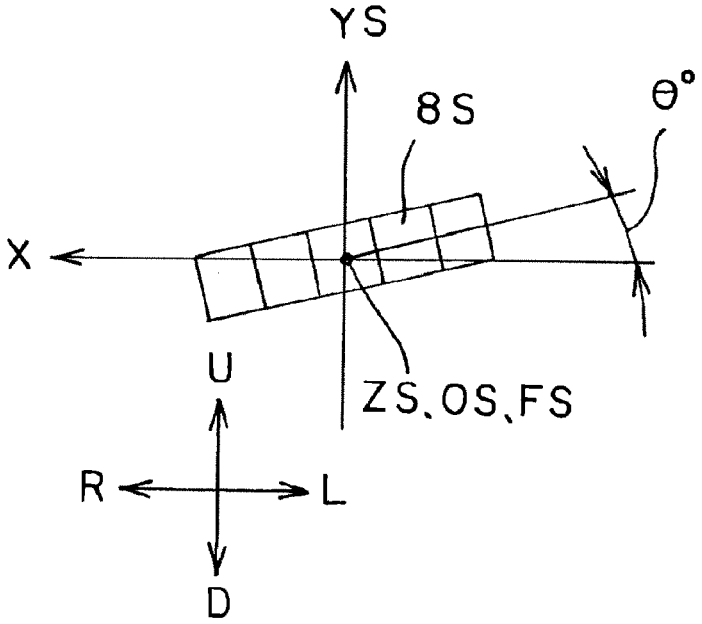

The light emitting chips 8S, 8W, as shown in FIGS. 10 and 11, are shaped like planar rectangles (planar oblongs), respectively. In other words, five square-shaped chips are arrayed in an X-axis direction (horizontal direction). Alternatively, one rectangular chip may be used instead of these chips.

Centers OS, OW of the light emitting chips 8S, 8W are positioned at or near reference focal points FS, FW of the lenses 3S, 3W, and are positioned on or near reference axes (optical axes) ZS, ZW of the lenses 3S, 3W, respectively. The reference axes ZS, ZW of the lenses 3S, 3W are parallel to the Z-axis, and are normal lines passing the centers OS, OW of the light emitting chips 8S, 8W, respectively. In addition, the X-axis passes through the centers OS, OW of the light emitting chips 8S, 8W. In FIGS. 10 and 11, axes YS, YW are parallel to the Y-axis and are a vertical axis (Y-axis) for spot light distribution and a vertical axis (Y-axis) for diffused light distribution, passing through the centers OS, OW of the light emitting chips 8S, 8W, respectively.

Light emitting faces of the light emitting chips 8S, 8W are oriented to the foreside F (forward direction) of the reference axes ZS, ZW of the lenses 3S, 3W, respectively. In addition, a long side of the light emitting chip 8W of the semiconductor-type light source 2W for diffused light distribution, as shown in FIG. 10, is parallel to the X-axis (horizontal axis) that is orthogonal to the reference axis ZW of the lens 3W. On the other hand, the long side of the light emitting chip 8S, of the semiconductor-type light source 2S for spot light distribution, as shown in FIG. 11, is tilted with respect to the X-axis in a state in which the light emitting chip 8S of the semiconductor-type light source 2S for spot light distribution is rotated by θ degrees (about 5 degrees, for example) around the reference axis ZS of the lens 3S so that the cruising lane side (left side L in the embodiment) becomes more upward than the opposite lane side (right side in the embodiment) with respect to the X-axis.

The long side of the light emitting chip 8S, of the semiconductor-type light source 2S for spot light distribution, may be parallel to the X-axis, like the one of the light emitting chip 8W of the semiconductor-type light source 2W for diffused light distribution. In addition, the long side of the light emitting chip 8S of the semiconductor-type light source 2S for spot light distribution may be tiled with respect to the X-axis, like the one of the light emitting chip 8W of the semiconductor-type light source 2W for diffused light distribution.

The lens 3S for spot light distribution and the lens 3W for diffused light distribution are constituted integrally with each other. A fixing portion 10 is integrally provided at a respective one of the left and right sides of the lenses 3S, 3W. The fixing portion 10 is fixed by tightening screws or the like on a respective one of the left and right sides of the front portion 5 of the heat sink member 4. As a result, the lenses 3S, 3W are fixed to the heat sink member 4.

The lenses 3S, 3W of a fixing type are provided with: incidence surfaces 11S, 11W to which light beams from the light emitting chips 8S, 8W of the semiconductor-type light sources 2S, 2W are incident; and emission faces 12S, 12W from which the light incident to the lenses 3S, 3W are emitted.

The incidence surfaces 11S, 11W of the lenses 3S, 3W are made of conically curved faces (a curve such as an ellipse, a circle, a parabola, or a hyperbola or a quadratic curved face such as a flat face, for example). In the embodiment, the incidence surfaces 11S, 11W of the lenses 3S, 3W form convex faces (cylindrical faces) in a state in which a respective one of the central portions thereof is convexly curved toward a backside B with respect to a peripheral portion. Although it is preferable that the incidence surfaces 11S, 11W of the lenses 3S, 3W form a convex face, the central portion may form a concave face concaved on the foreside F with respect to the peripheral portion in the vertical cross section or may be flat. The light beams, a respective one of which is formed at an angle leading up to θ1 degrees (for example, about 50 degrees or more, or alternatively, 60 degrees in the embodiment), from the centers OS, OW of the light emitting chips 8S, 8W of the semiconductor-type light sources 2S, 2W (reference axes ZS, ZW of the lenses 3S, 3W), are incident to the incidence surfaces 11S, 11W of the lenses 3S, 3W.

The emission surfaces 12S, 12W of the lenses 3S, 3W are made of free curved faces controlled to be curved so that: projection images of the light emitting chips 8S, 8W, emitted from the emission surfaces 12S, 12W of the lenses 3S, 3W, are disallowed to protrude in an upward direction from cutoff lines CL1, CL2, CL3 on a screen light distribution of the light distribution pattern LP for low beam; and a part of the projection images of the light emitting chips 8S, 8W is substantially in contact with the cutoff lines CL1, CL2, CL3.

Hereinafter, a curved face control of the emission surface 12S of the lens 3S for spot light distribution will be described referring to FIGS. 4 and 12 to 15.

First, the semiconductor-type light source 2S and the lens 3S, for the spot light distribution, are disposed so as to be constituted as described previously. A conically curved face of the incidence surface 11S of the lens 3S is fixed. On the other hand, a free curved face, of the emission surface 12S of the lens 3S, is defined as an initial free curved face.

Figure 12:
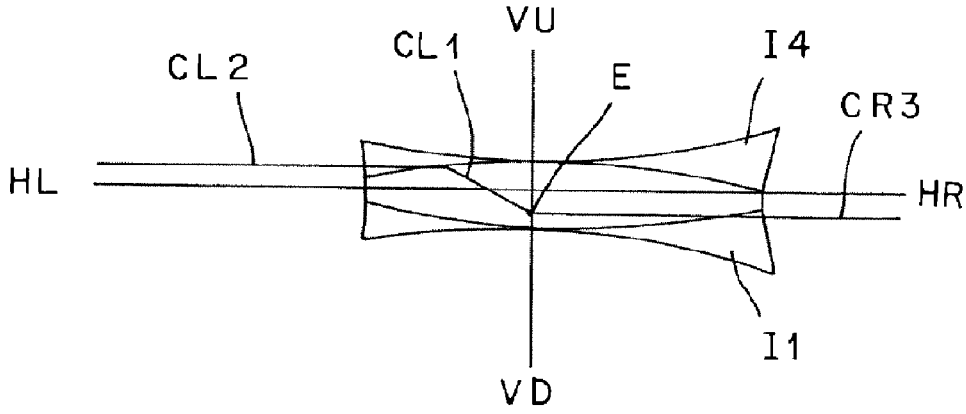
FIG. 12 is an explanatory view showing a projection image of the light emitting chip of the semiconductor-type light source for spot light distribution, which is emitted from a first quadrant and a fourth quadrant when an emission surface of the lens for spot light distribution is established in an initial state, similarly.
Figure 13:
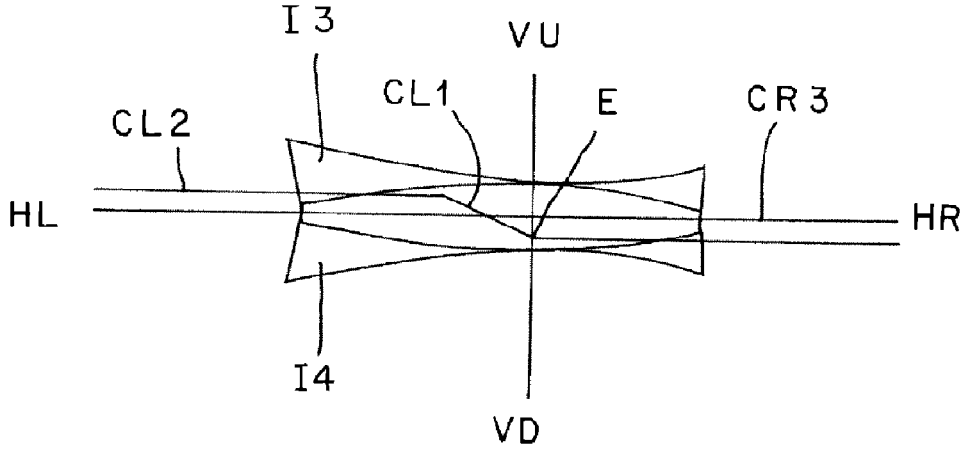
FIG. 13 is an explanatory view showing a projection image of the light emitting chip of the semiconductor-type light source for spot light distribution, which is emitted from a second quadrant and a third quadrant when the emission surface of the lens for spot light distribution is established in an initial state, similarly.

Next, a light emitting chip 8S of the semiconductor-type light source 2S is lit to emit light. A projection image group of the light emitting chip 8S is screen-projected (emitted). Hereinafter, a description will be given with respect to projection images I1, I2, I3, I4 of the light emitting chip 8S, to be emitted from sampling points P1, P2, P3, P4 of the emission surface 12S of the lens 3S shown in FIG. 4. The projection images I1, I2, I3, I4 of the light emitting chip 8S are screen-projected (emitted), as shown in FIGS. 12 and 13. At this time, since a free curved face of the emission surface 12S of the lens 3S is an initial free curved face, a part of the screen-projected projection images I1, I2, I3, I4 (a half or more portion) projects upward from the cutoff lines CL1, CL2, CL3 on the screen light distribution of the light distribution pattern LP for low beam.

Figure 14:
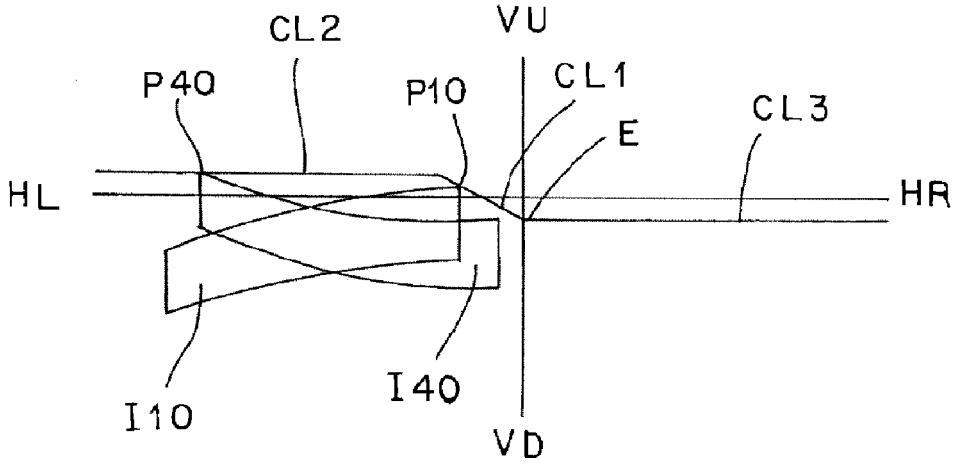
FIG. 14 is an explanatory view showing a projection image of the light emitting chip of the semiconductor-type light source for spot light distribution, which is emitted from the first quadrant and the fourth quadrant when the emission surface of the lens for spot light distribution is controlled to be curved, similarly.
Figure 15:
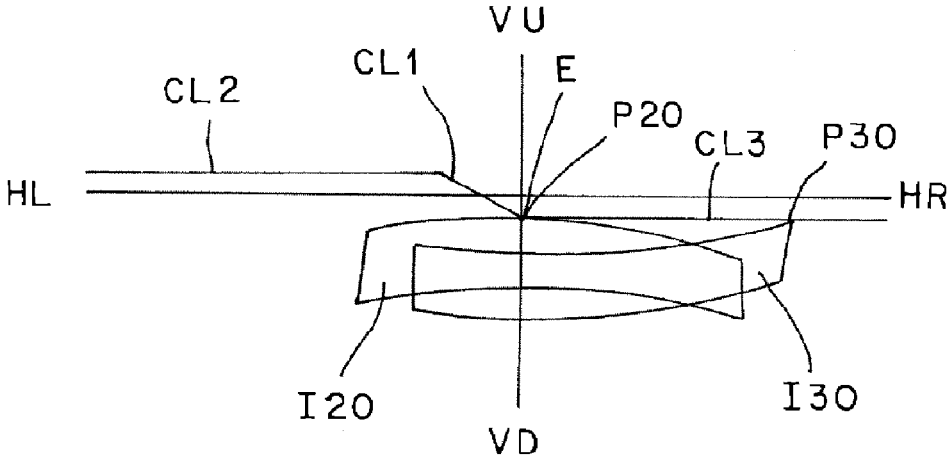
FIG. 15 is an explanatory view showing a projection image of the light emitting chip of the semiconductor-type light source for spot light distribution, which is emitted from the second quadrant and the third quadrant when the emission surface of the lens for spot light distribution is controlled to be curved, similarly.

Afterward, the projection images I1, I2, I3, I4 shown in FIGS. 12 and 13 are design-modified to projection images I10, I20, I30, I40 shown in FIGS. 14 and 15. Parts P10, P20, P30, P40 of the design-modified projection images I10, 120, 130, 140 are substantially in contact with the cutoff lines CL1, CL2, CL3 on the screen light distribution of the light distribution pattern LP for low beam; and the design-corrected projection images I10, I20, I30, I40 are disallowed to protrude in an upward direction from the cutoff lines CL1, CL2, CL3 on the screen light distribution of the light distribution pattern LP for low beam.

Afterward, the curved face of a free curved face of the emission surface 12S of the lens 3S for spot light distribution is controlled so that the design-modified projection images I10, I20, I30, I40 are obtained. In such a manner as described above, the free curved face of the emission surface 12S of the lens 3S for spot light distribution is obtained. Further, the one of the emission surface 12W of the lens 3W for diffused light distribution is obtained, similarly.

Figure 6:
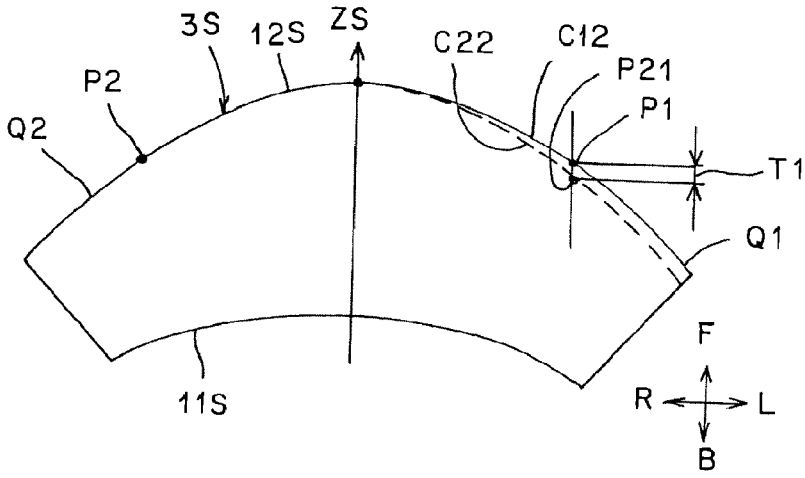
FIG. 6 is a sectional view taken along the line VI-VI of FIG. 4, showing the lens for spot light distribution, similarly.
Figure 7:
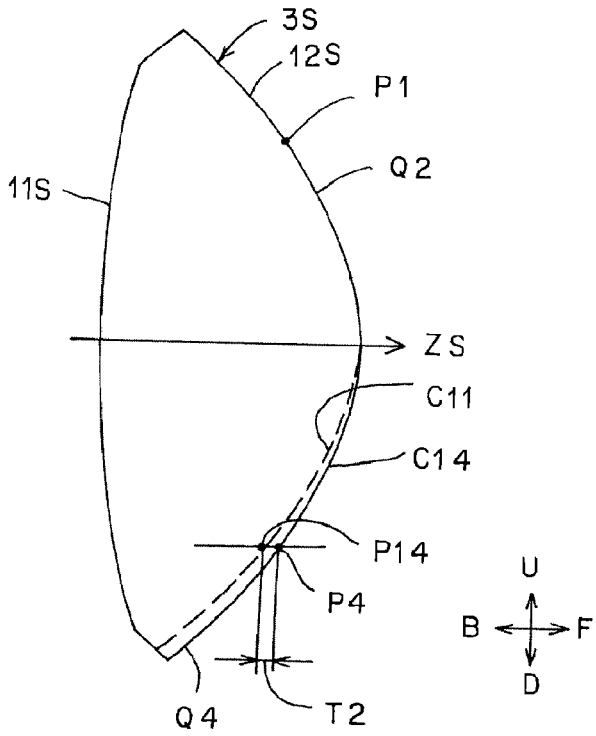
FIG. 7 is a sectional view taken along the line VII-VII of FIG. 4, showing the lens for spot light distribution, similarly.
Figure 8:
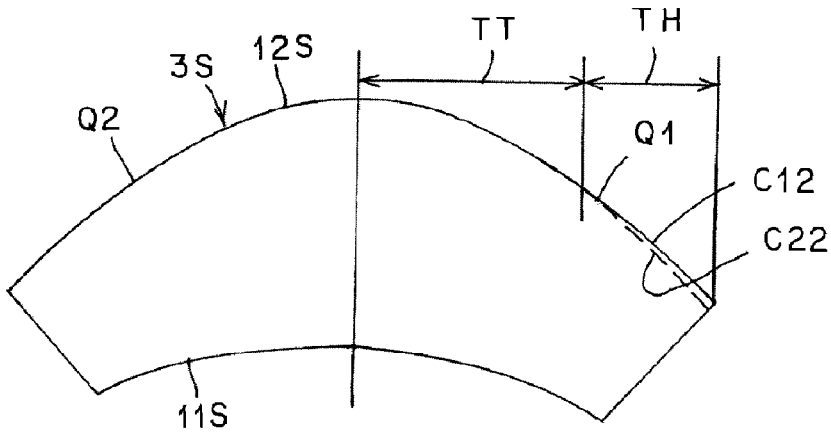
FIG. 8 is a sectional view corresponding to that of FIG. 7, showing a modified example of the lens for spot light distribution, similarly.
Figure 9:
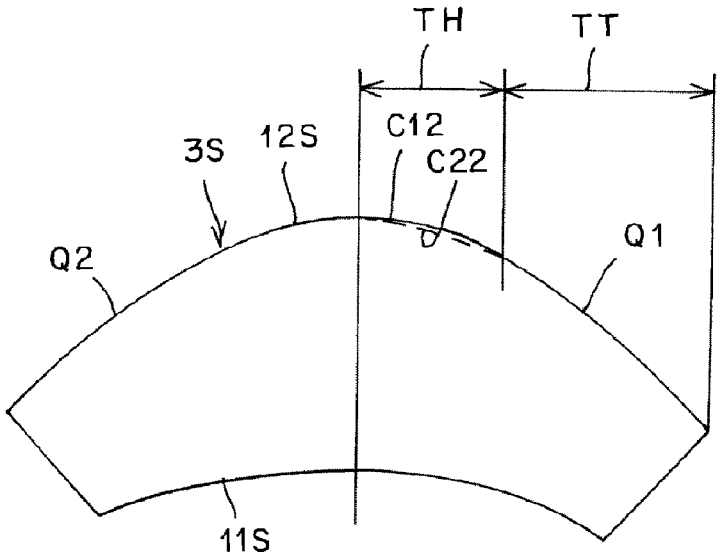
FIG. 9 is a sectional view corresponding to that of FIG. 7, showing another modified example of the lens for spot light distribution, similarly.

The free curved faces of the emission surfaces 12S, 12W of the lenses 3S, 3W controlled to be curved as described above have the following features. In other words, as shown in FIGS. 4 to 7, in a state in which the reference axes ZS, ZW of the lenses 3S, 3W are defined as origins in a front view (the state seen from the foreside F), the free curved faces of the emission surfaces 12S, 12W of the lens 3S, 3W are divided into a first quadrant Q1, a second quadrant Q2, a third quadrant Q3, and a fourth quadrant Q4 by means of the vertical axis YS, YW and an X axis serving as a horizontal axis, the axis passing through the origin and being orthogonal to each other. Hereinafter, in the lens 3S for spot light distribution, in a case where the first quadrant Q1 and the second quadrant Q2 are compared with each other in a symmetrical position relationship with respect to the vertical axis YS, i.e., in a case where a sectional curve C12 in the first quadrant Q1, passing through the first sampling point P1 and the second sampling point P2, obtained when the first quadrant Q1 and the second quadrant Q2 of the lens 3S for spot light distribution are cut on a horizontal face parallel to the X axis as the horizontal axis, passing the first sampling point P1 and the second sampling point P2 is compared with an inverted sectional curve C22 of the second quadrant Q2 in the first quadrant Q1, which is a sectional curve in the second quadrant Q2 and is inverted around the vertical axis YS, a portion of about ⅓ or more of the first quadrant Q1 (all of the first quadrant in the embodiment) is higher than the second quadrant Q2 in the forward direction (foreside F) of the reference axis ZS of the lens 3S. For example, as shown in FIG. 6, in a case where the first sampling point P1 in the first quadrant Q1 is compared with an inversion point P21 of the second sampling point P2 of the second quadrant Q2 in the first quadrant Q1, the first sampling point P1 in the first quadrant Q1 is higher by a dimension T1 in the foreside F than the inversion point P21 of the second sampling point P2 of the second quadrant Q2 in the first quadrant Q1. A portion TH, which becomes higher than the second quadrant Q2 of the first quadrant Q1, is from about ⅓ to 1 ($\frac{1}{3}<TH\leqq 1$). The portion TH which becomes higher, as shown in FIG. 8, may start from an edge of the lens 3S. Alternatively, as shown in FIG. 9, it may start from a center of the lens 3S. Further, although not shown, it may start from an intermediate position between an edge and a center of the lens 3S. In FIGS. 8 and 9, a portion TT is the one having the same height as that of the second quadrant Q2 of the first quadrant Q1.

In the lens 3S for spot light distribution, in a case where the first quadrant Q1 and the fourth quadrant Q4 are compared with each other in a symmetrical position relationship with respect to the X axis as the horizontal axis, i.e., in a case where a sectional curve C14 in the fourth quadrant Q4, passing through the first sampling point P1 and the fourth sampling point P4, obtained when the first quadrant Q1 and the fourth quadrant Q4 of the lens 3S for spot light distribution are cut on a vertical face parallel to the vertical axis YS passing through the first sampling point P1 and the fourth sampling point P4, is compared with an inverted sectional curve C11 of the first quadrant Q1 in the fourth quadrant Q4, which is a sectional curve in the first quadrant Q1 and is inverted around the X axis as the horizontal axis, a portion of about ⅓ or more of the first quadrant Q1 is lower than the fourth quadrant Q4 in the forward direction (foreside F) of the reference axis ZS of the lens 3S. For example, as shown in FIG. 7, in a case where the fourth sampling point P4 in the fourth quadrant Q4 is compared with an inversion point P14 of the first sampling point P1 of the first quadrant Q1 in the fourth quadrant Q4, the inversion point P14 of the first sampling point P1 of the first quadrant Q1 in the fourth quadrant Q4 is lower than the fourth sampling point P4 in the fourth quadrant Q4 by a dimension T2 in the foreside F. A portion, which becomes lower than the fourth quadrant Q4 of the first quadrant Q1, is from about ⅓ to all. The portion that becomes lower may start from an edge of the lens 3S, or alternatively, may start from a center of the lens 3S. Further, it may start from an intermediate portion between the edge and the center of the lens 3S.

On the other hand, a free curved face of the emission surface 12W of the lens 3W for diffused light distribution also has a feature similar to that of the emission surface 12S of the lens 3S for spot light distribution. In other words, the free curved face of the emission surface 12W of the lens 3W for diffused light distribution is made of a free curved face on which: in a case where the first quadrant Q1 and the second quadrant Q2 are compared with each other in a symmetrical position relationship with respect to the vertical axis YW, a portion of about ⅓ or more of the first quadrant Q1 is higher than the second quadrant Q2 in the forward direction of the reference axis ZW of the lens 3W; and in a case where the first quadrant Q1 and the fourth quadrant Q4 are compared with each other in a symmetrical position relationship with respect to the X axis as the horizontal axis, the portion of about ⅓ or more of the first quadrant Q1 is lower than the fourth quadrant Q4 in the forward direction of the reference axis ZW of the lens 3W.

Hereinafter, the projection images I10, I20, I30, I40 of the light emitting chips 8S, 8W, which are emitted from four sampling points P1, P2, P3, P4 of the emission surfaces 12S, 12W controlled to be curved, of the lenses 3S, 3W, are design-modified from the states of FIGS. 12 and 13 and to the state of FIGS. 14 and 15.

Figure 16A:
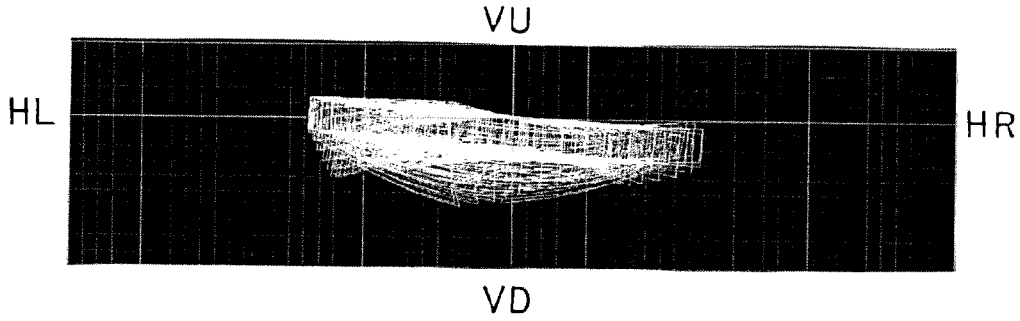
FIGS. 16A to 16E are explanatory views, each of which shows a spot light distribution obtained by means of a lamp unit made of the semiconductor-type light source and lens for spot light distribution (a projection image group of the light emitting chip of the semiconductor-type light source for spot light distribution), similarly.
Figure 16B:
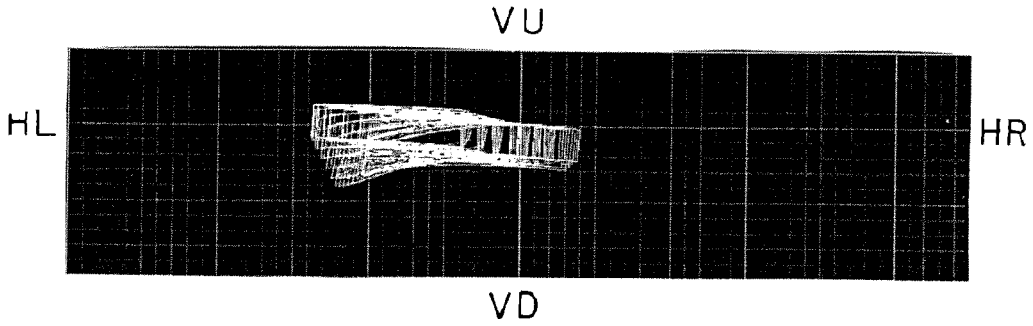

As a result, as shown in FIG. 16B, the projection image group of the light emitting chip 8S, which is emitted from the first quadrant Q1 of the light emission surface 12S of the lens 3S for spot light distribution, mainly forms a light distribution of the cruising lane side (left side) from the elbow point E on the screen light distribution of the light distribution pattern LP for low beam.

Figure 16C:
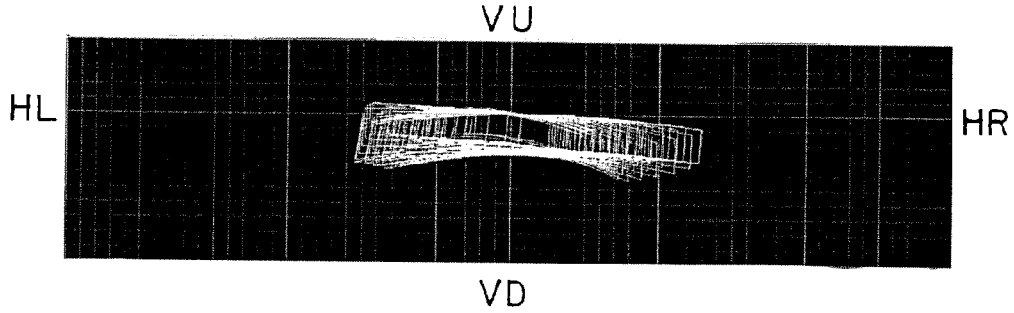

In addition, as shown in FIG. 16C, the projection image group of the light emitting chip 8S, which is emitted from the second quadrant Q2 of the emission surface 12S of the lens 3S for spot light distribution, mainly forms a light distribution of the opposite lane side (right side) from the elbow point E on the screen light distribution of the light distribution pattern LP for low beam.

Figure 16D:
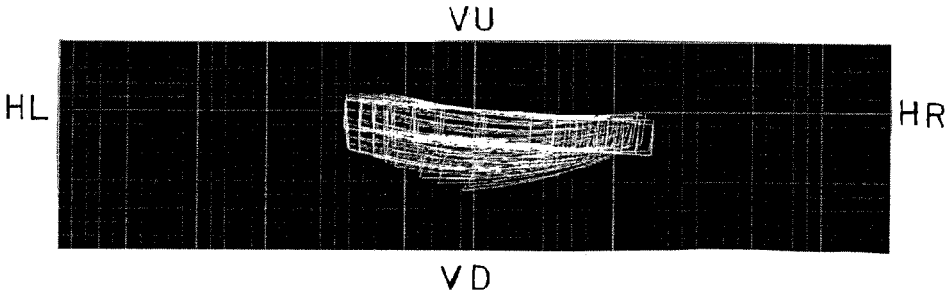

Further, as shown in FIG. 16D, the projection image group of the light emitting chip 8S, which is emitted from the third quadrant Q3 of the emission surface 12S of the lens 3S for spot light distribution, mainly forms a light distribution of the opposite lane side (right side) from the elbow point E on the screen light distribution of the light distribution pattern LP for low beam.

Figure 16E:
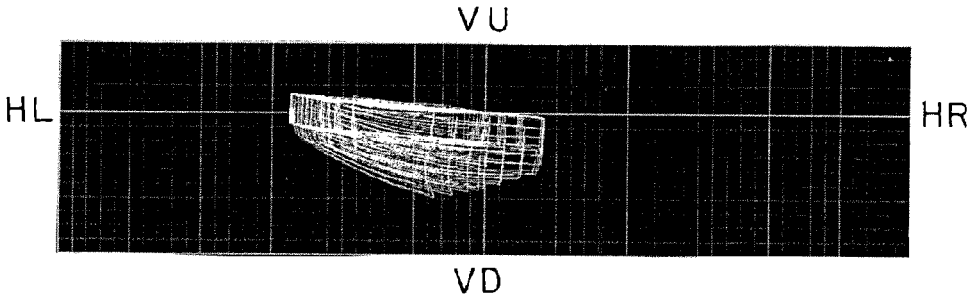

Furthermore, as shown in FIG. 16E, the projection image group of the light emitting chip 8S, which is emitted from the fourth quadrant Q4 of the emission surface 12S of the lens 3S for spot light distribution, mainly forms a light distribution of the cruising lane side (left side) from the elbow point E on the screen light distribution of the light distribution pattern LP for low beam.

Afterward, a spot light distribution SP of the light distribution pattern LP for low beam, shown in FIG. 16A, is formed by combining the light distributions shown in FIGS. 16B, 16C, 16D, and 16E with each other.

Figure 17A:
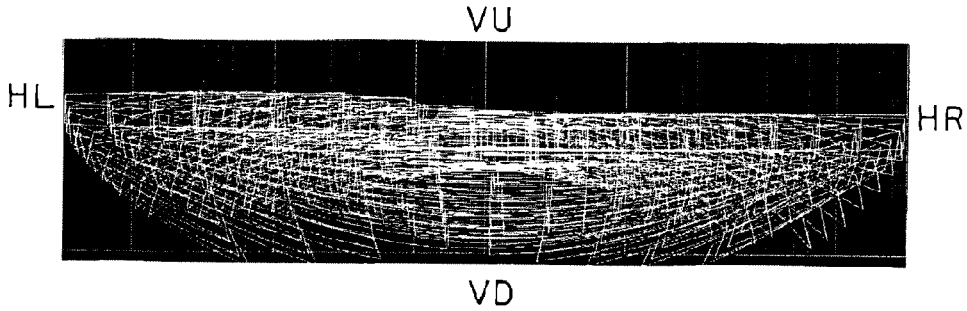
FIGS. 17A to 17E are explanatory views, each of which shows a diffused light distribution obtained by means of a lamp unit made of the semiconductor-type light source and lens for diffused light distribution (a projection image group of the light emitting chip of the semiconductor-type light source for diffused light distribution), similarly.
Figure 17B:
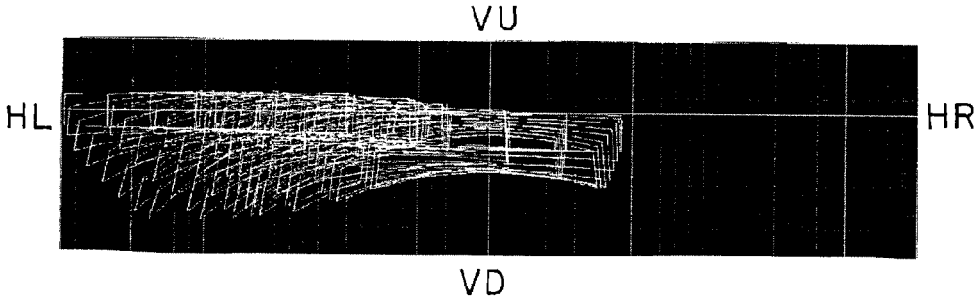

On the other hand, as shown in FIG. 17B, the projection image group of the light emitting chip 8W, which is emitted from the first quadrant Q1 of the light emission surface 12W of the lens 3W for spot light distribution, mainly forms a light distribution of the cruising lane side (left side) from the elbow point E on the screen light distribution of the light distribution pattern LP for low beam.

Figure 17C:
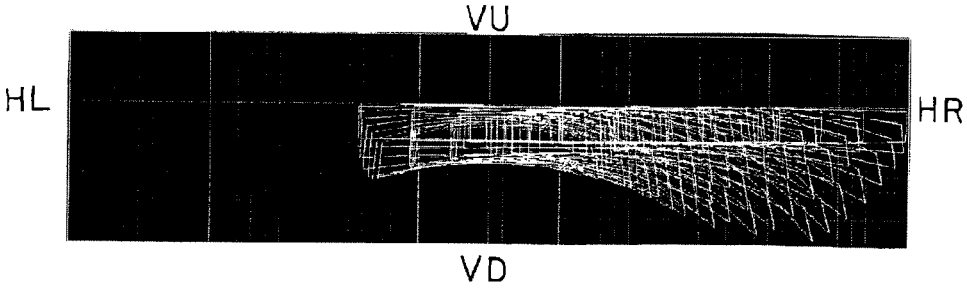

In addition, as shown in FIG. 17C, the projection image group of the light emitting chip 8W, which is emitted from the second quadrant Q2 of the light emission surface 12W of the lens 3W for spot light distribution, mainly forms a light distribution of the opposite lane side (right side) from the elbow point E on the screen light distribution of the light distribution pattern LP for low beam.

Figure 17D:
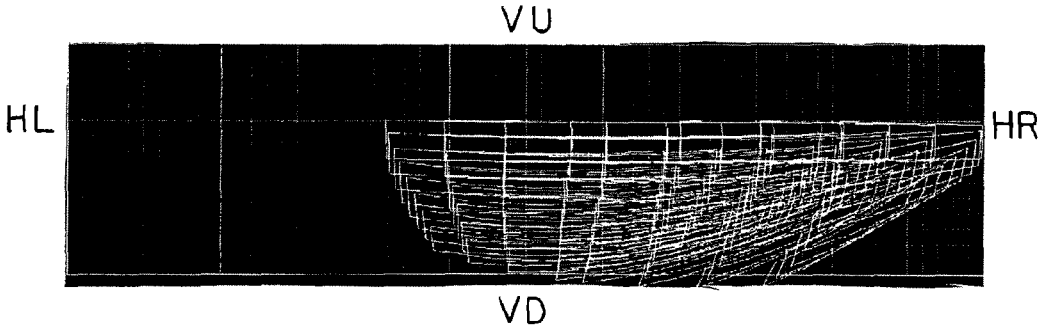

Further, as shown in FIG. 17D, the projection image group of the light emitting chip 8W, which is emitted from the third quadrant Q3 of the light emission surface 12W of the lens 3W for spot light distribution, mainly forms a light distribution of the opposite lane side (right side) from the elbow point E on the screen light distribution of the light distribution pattern LP for low beam.

Figure 17E:
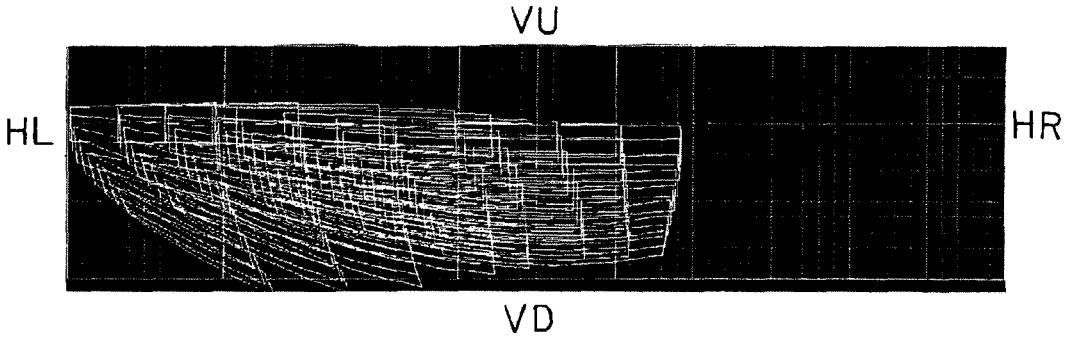

Furthermore, as shown in FIG. 17E, the projection image group of the light emitting chip 8W, which is emitted from the fourth quadrant Q4 of the light emission surface 12W of the lens 3W for spot light distribution, mainly forms a light distribution of the cruising lane side (left side) from the elbow point E on the screen light distribution of the light distribution pattern LP for low beam.

Afterward, a diffused light distribution WP of the light distribution pattern LP for low beam, shown in FIG. 17A, is formed by combining the light distributions shown in FIGS. 17B, 17C, 17D, and 17E with each other.

As shown in FIGS. 2, 20 to 23, the reflector 16 is fixed to a peripheral portion of a fixing face at a foreside of the front portion 5 of the heat sink member 4. At a central portion of the reflector 16 of a fixing type, there is provided an opening 17 at which the semiconductor-type light sources 2S, 2W, the lenses 3S, 3W, the light shading member 13S, 13W, or the prism members 14S, 14W are positioned. In addition, a reflection surface 18 of a free curved face is provided at a peripheral rim of the reflector 16 of a fixing type. The reflecting surface 18 is a reflecting surface for forwardly reflecting light L2 (light L2 that is out of lens incidence, having an angle of equal and more than θ1 degrees) other than light L1 from the light emitting chips 8S, 8W of the semiconductor-type light source 2S, 2W, which is incident to the lenses 3S, 3W (the light emitted from centers OS, OW of light emitting chips 8S, 8W of the semiconductor-type light sources 2S, 2W (reference axes ZS, ZW of the lenses 3S, 3W) to θ1 degrees, as shown in FIG. 3), as a spot light distribution SP2 including a main optical axis SZ of the light distribution pattern HP for high beam, shown in FIG. 35. The main optical axis SZ of the spot light distribution SP2 is positioned at or near a crossing point between the left-right horizontal line HL-HR and upside-downside vertical line VU-VD of a screen at an upside U more than the elbow point E of the light distribution pattern LP for low beam, shown in FIG. 32 (refer to the main optical axis SZ of the spot light distribution SP2 indicated by the dotted lines of FIGS. 33 and 34). The spot light distribution SP2 including the main optical axis SZ is formed by means of the semiconductor-type light sources 2S, 2W and the reflecting surface 18 of the reflector 16, which are fixed to the heat sink member 4, respectively, so that the spot light distribution SP2 including the main optical axis SZ is positionally fixed without being shifted therefrom.

As shown in FIGS. 2, 18 to 22, and 26 to 28, at central portions of the light shading members 13S, 13W of a movable type, openings 19S, 19W are provided so as to disallow a part L1 of the light beams from the light emitting chips 8S, 8W of the semiconductor-type light sources 2S, 2W to be hindered from being incident to the lenses 3S, 3W. At peripheral rims of the light shading members 13S, 13W, square-shaped light shading frames 20S, 20W are provided for shading the light L2 that is out of lens incidence from the light emitting chips 8S, 8W of the semiconductor-type light sources 2S, 2W, the light being to be incident to the reflecting surface 18. The light shading members 13S, 13W are disposed to be movable between the first location and the second location, and as shown in FIG. 22, when they are positioned in the first location, a part L1 of the light beams from the light emitting chips 8S, 8W of the semiconductor-type light sources 2S, 2W is disallowed to be hindered from passing through the openings 19S, 19W and being incident to the incidence surfaces 11S, 11W of the lenses 3S, 3W, and the light L2 that is out of the lens incidence from the light emitting chips 8S, 8W of the semiconductor-type light sources 2S, 2W, the light being to be incident to the reflecting surface 18, is shaded by means of the light shading frames 20S, 20W.

Similarly, as shown in FIGS. 2, 18 to 21, 23, and 25 to 28, the prism members 14S, 14W of a movable type are integrally structured in a crossing shape with the light shading members 13S, 13W of a movable type. The prism members 14S, 14W of a movable type are provided with: incidence surfaces 21S, 21W to which the light L1 from the light emitting chips 8S, 8W of the semiconductor-type light sources 2S, 2W is to be incident; and emission surfaces 22S, 22W from which the light incident to the prism members 14S, 14W is to be emitted.

The emission surfaces 22S, 22W of the prism members 14S, 14W are made of conical curved faces (such as curves such as ellipses, circles, parabolas, or hyperbolas, or alternatively, quadratic curved faces such as flat faces, for example). In the embodiment, these emission surfaces are made of flat faces.

Figure 25:
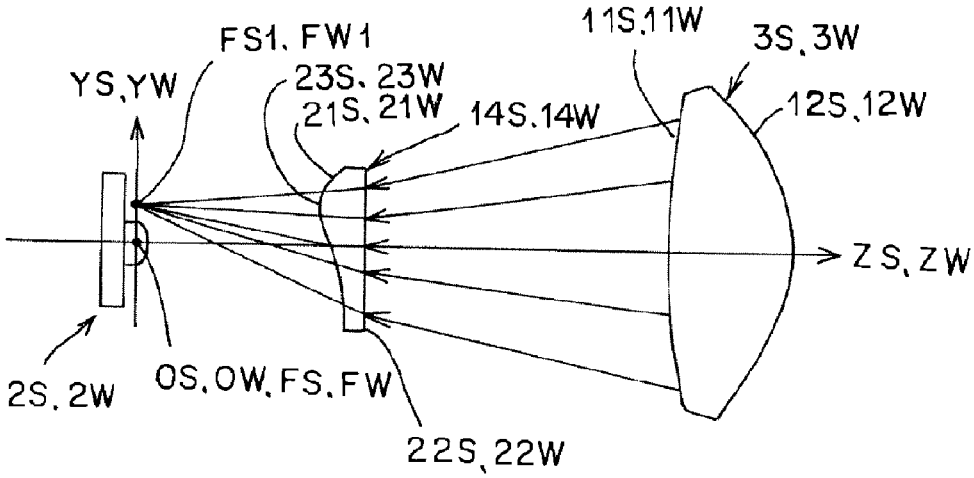
FIG. 25 is an explanatory view showing an optical path when the lens reference focal point has been moved upward of the center of the light emitting chip by means of the prism member, similarly.
Figure 26:
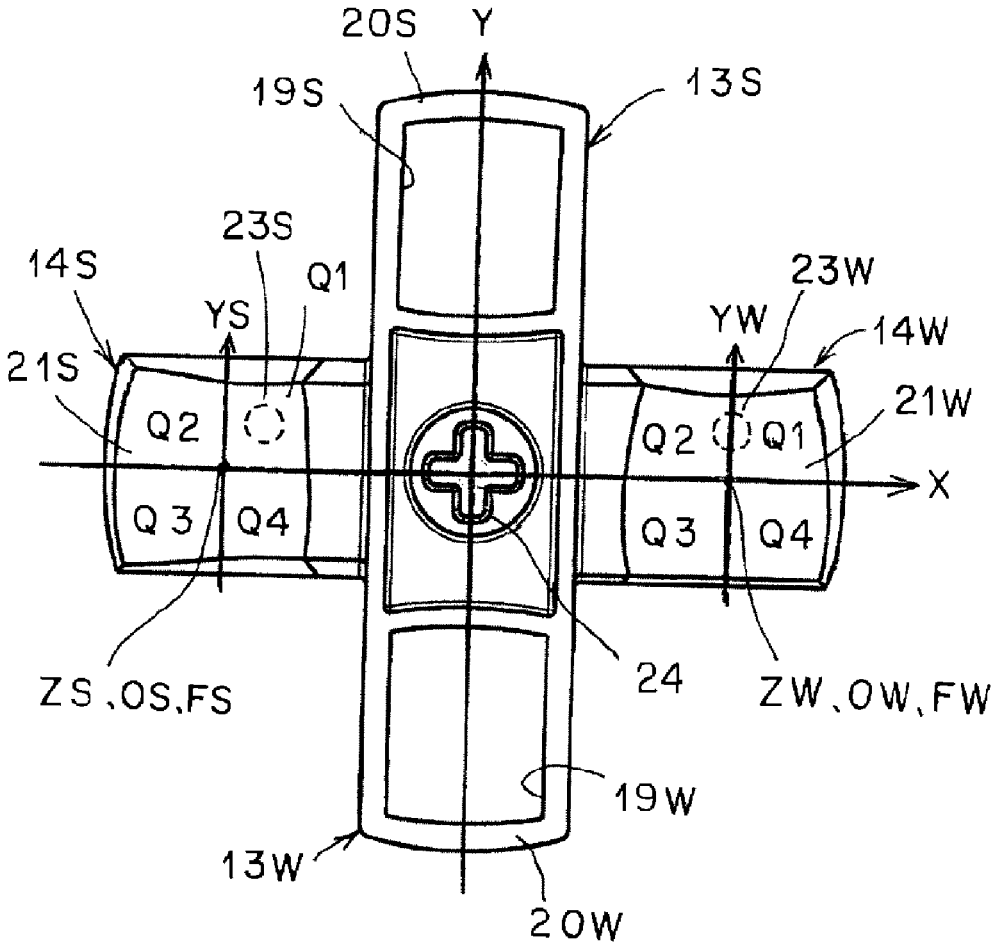
FIG. 26 is a rear view showing the light shading member and the prism member when the prism member is positioned in the first location, similarly.
Figure 27:
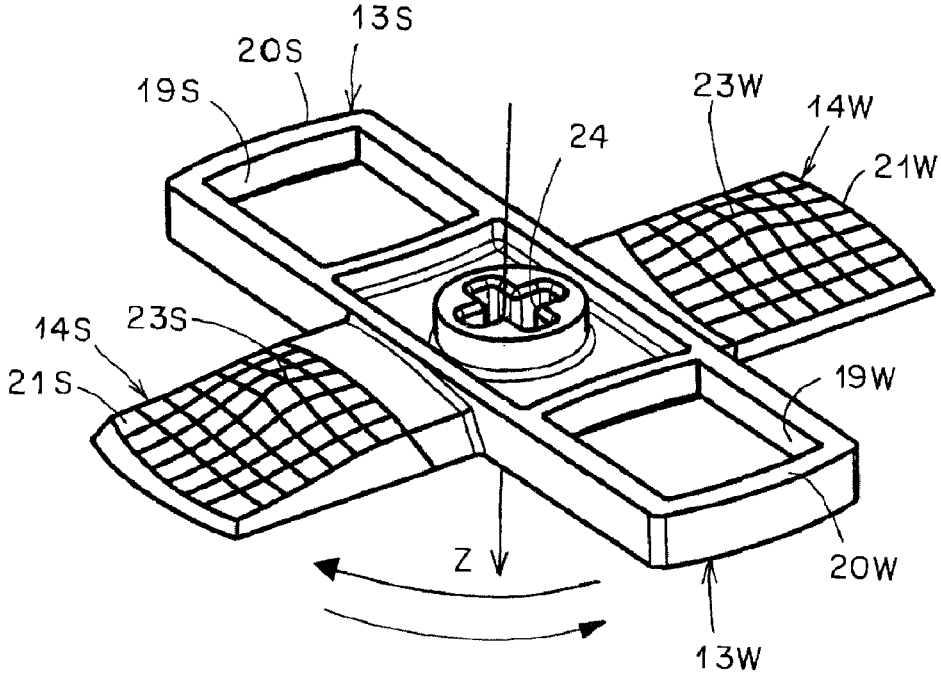
FIG. 27 is a perspective view showing the light shading member and the prism member, similarly.
Figure 28:
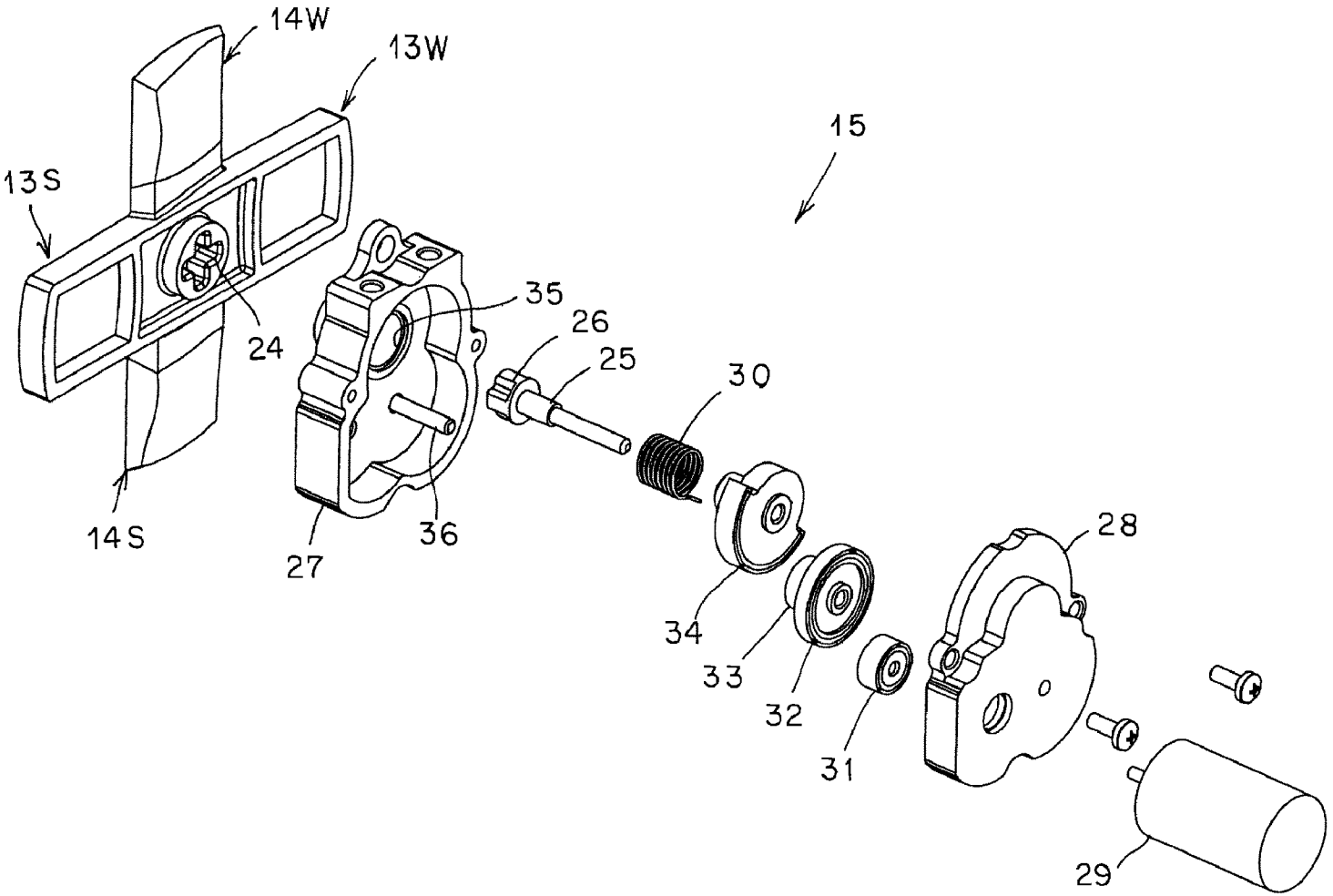
FIG. 28 is an exploded perspective view showing components of the light shading member, the prism member, and the switching device, similarly.
Figure 29:
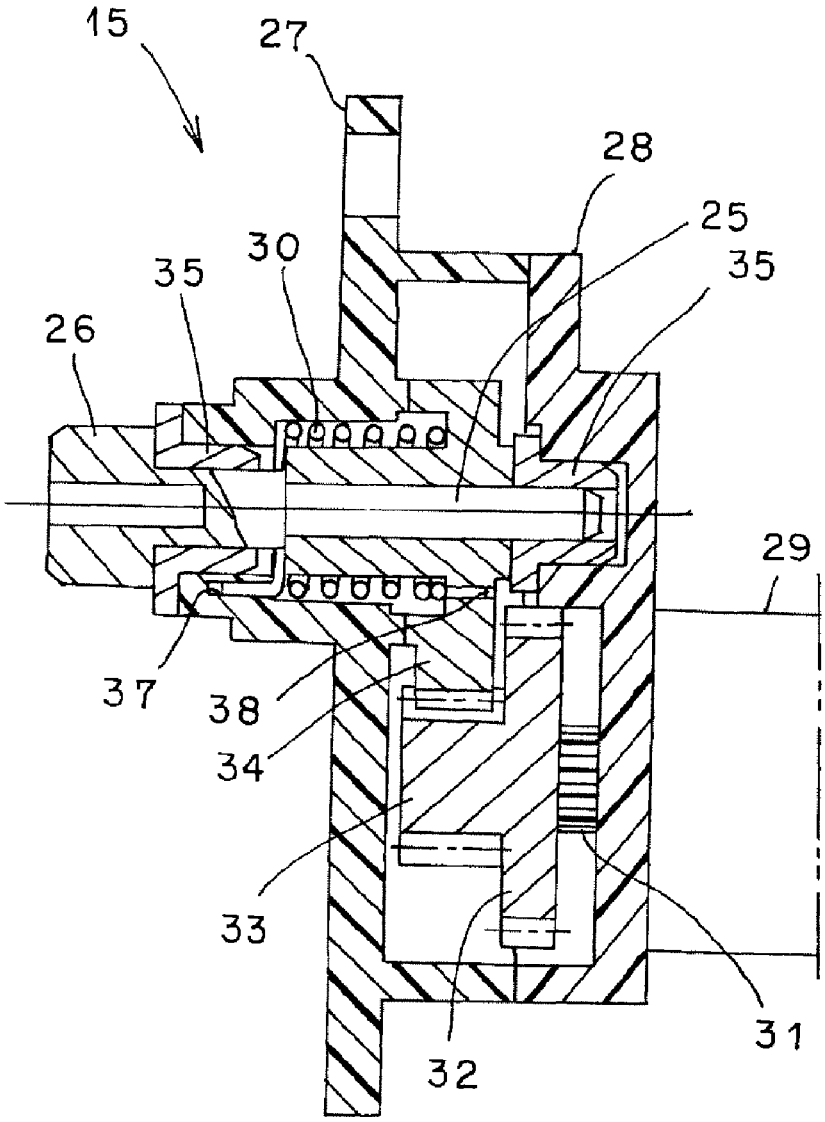
FIG. 29 is a longitudinal sectional view of essential parts of the switching device, similarly.

The incidence surface 21S of the prism member 14S for spot light distribution is made of a free curved face controlled to be curved so as to virtually move a reference focal point FS of the lens 3S for spot light distribution to the right oblique upside (refer to a virtual lens reference focal point FS1 of FIG. 25). A free curved face of the incidence surface 21S of the prism member 14S for spot light distribution has a convex portion 23S which are convexly curved toward the semiconductor-type light source 2S for spot light distribution (refer to the small dotted circle of FIG. 26 and the ridgeline of FIG. 27). A peak of the convex portion 23S, as shown in FIG. 26, is present at a portion of the first quadrant Q1 in a state in which the first quadrant Q1, the second quadrant Q2, the third quadrant Q3, and the fourth quadrant Q4, passing through an origin and divided by the vertical axis YS and the X-axis as a horizontal axis, which are orthogonal to each other, are defined with the reference axis ZS of the lens 3S for spot light distribution serving as the origin in a rear view (the state seen from the backside B).

On the other hand, the incidence surface 21W of the prism member 14W for diffused light distribution is made of a free curved face controlled to be curved so as to virtually move the reference focal point FW of the lens 3W for diffused light distribution to the upside (refer to the virtual lens reference focal point FW1 of FIG. 25). A free curved face of the incidence surface 21W of the prism member 14W for diffused light distribution has a convex portion 23W which is convexly curved toward the semiconductor-type light source 2W for diffused light distribution (refer to the small dotted circle of FIG. 26 and the ridgeline of FIG. 27). A peak of the convex portion 23W, as shown in FIG. 26, is present at a portion across the first quadrant Q1 and the second quadrant Q2 in a state in which the first quadrant Q1, the second quadrant Q2, the third quadrant Q3, and the fourth quadrant Q4, passing through an origin and divided by the vertical axis YW and the X-axis as a horizontal axis, which are orthogonal to each other, are defined with the reference axis ZW of the lens 3W for diffused light distribution serving as the origin in a rear view (the state seen from the backside B).

The prism members 14S, 14W are integrally structured with the light shading members 13S, 13W, and are disposed to be movable between the first location and the second location replaceably from the light shading members 13S, 13W. As shown in FIG. 23, when the prism members 14S, 14W are positioned in the first location, a part L1 of the light beams from the light emitting chips 8S, 8W of the semiconductor-type light sources 2S, 2W is incident to the incidence surfaces 11S, 11W of the lenses 3S, 3W in a state in which: the light L2 that is out of the lens, incidence from the light emitting chips 8S, 8W of the semiconductor-type light sources 2S, 2W, is disallowed to be hindered from being incident to the reflecting surface 18; and the reference focal points FS, FW of the lenses 2S, 2W are virtually moved to the virtual lens reference focal points FS1, FW1.

The light shading members 13S, 13W and the prism members 14S, 14W are integrally constituted in a crossing shape. An engagement groove 24 formed in a crossing shape is provided at a central portion of a respective one of the light shading members 13S, 13W and the prism members 14S, 14W. The engagement groove 24 is engaged with the engagement portion 26 that is formed in a crossing shape, of the shaft 25 of the switching device 25. As a result, the light shading members 13S, 13W and the prism members 14S, 14W are disposed to be replaceably movable between the first location and the second location by means of the switching device 15.

The switching device 15, as shown in FIGS. 2, 18, 19, and 28 to 31, is provided with the shaft 25, housings 27, 28, a motor 29, a deceleration mechanism; and a spring 30 for fail save (for restoration).

The housings 27, 28 are divided into two sections, a foreside housing 27 and a backside housing 28. The shaft 25 is accommodated in the housings 27, 28 and is rotatably supported on the housings 27, 28 via a bearing 35. In addition, a front end of the shaft 25 protrudes forward from the foreside housing 27. The engagement portion 26 is provided at the front end of the shaft 25. The engagement portion 26 is engaged with the engagement groove 24 of the light shading members 13S, 13W and the prism members 14S, 14W, which are integrally structured with each other.

As the motor 29, a stepping motor is used in the embodiment. A motor other than the stepping motor may be used. The motor 29 is mounted on an exterior face of the backside housing 28.

The deceleration mechanism is made up of: a first gear 31; a second gear 32; a third gear 33; and a fourth gear 34. The first gear 31 is fixed to an output shaft (drive shaft, rotary shaft) of the motor 20. The second gear 32 and the third gear 33 are coaxially fixed to each other, and are rotatably supported on a shaft portion 36 of the foreside housing 27. The fourth gear 34 is fixed to the shaft 25.

The first gear 31 and the second gear 32 are meshed with each other. The third gear 33 and the fourth gear 34 are meshed with each other. The number of teeth of the first gear 31 is smaller than that of the second gear 32. The number of teeth of the second gear 32 is larger than that of the third gear 33. The number of teeth of the third gear 33 is smaller than that of the fourth gear 34.

The spring 30 is a coil spring in the embodiment. One end of the spring 30 engages with an engagement hole 37 of the foreside housing 27. In addition, the other end of the spring 30 is engaged with an engagement hole 38 of the fourth gear 34. The spring 30 may be a spring other than the coil spring. In addition, one end of the spring 30 may engage with a fixing-side member other than the foreside housing 27. Further, the other end of the spring 30 may engage with a rotary-side member other than the fourth gear 34.

A first stopper stepped portion 39 and a second stopper stepped portion 40 are provided, respectively, at the fourth gear 34. On the other hand, a first stopper convex portion 41 against which the first stopper stepped portion 39 is in abutment, and a second stopper convex portion 42 against which the second stopper stepped portion 40 is in abutment are provided, respectively, at the foreside housing 27.

Figure 18:
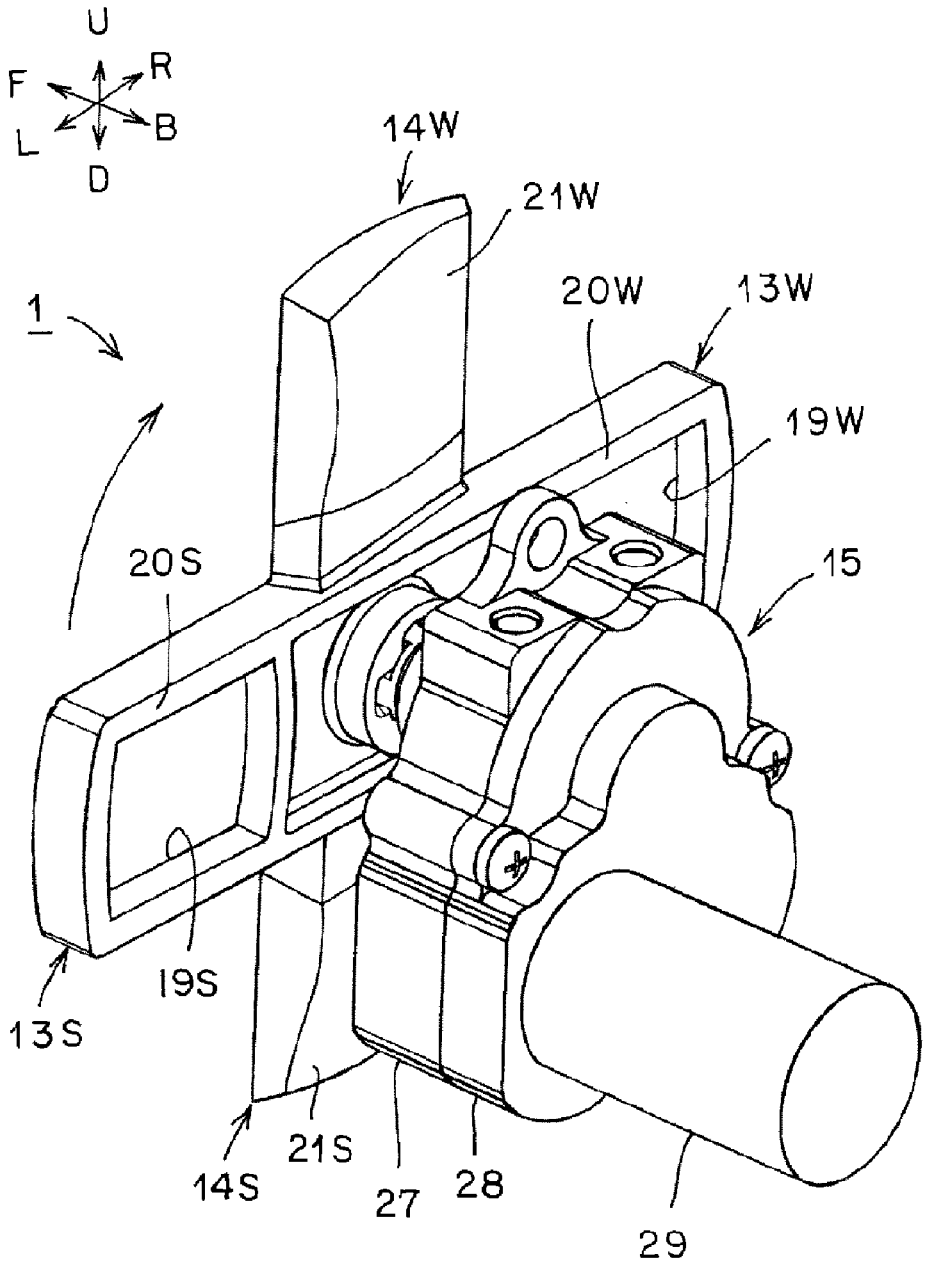
FIG. 18 is a perspective view of a light shading member, a prism member, and a switching device, showing a state in which the light shading member is positioned in a first location, similarly.
Figure 19:
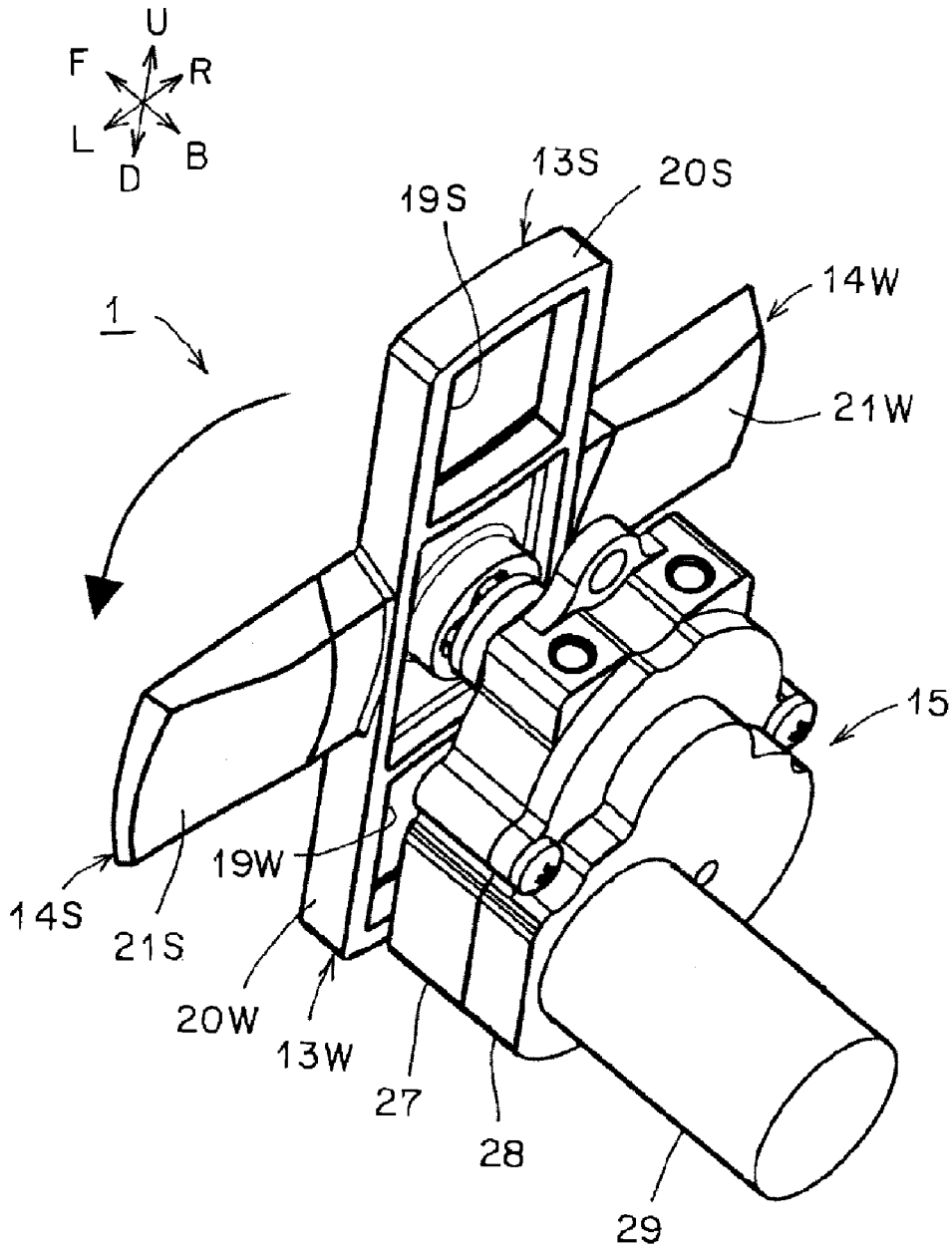
FIG. 19 is a perspective view of a light shading member, a prism member, and a switching device, showing a state in which the prism member is positioned in the first location, similarly.
Figure 20:
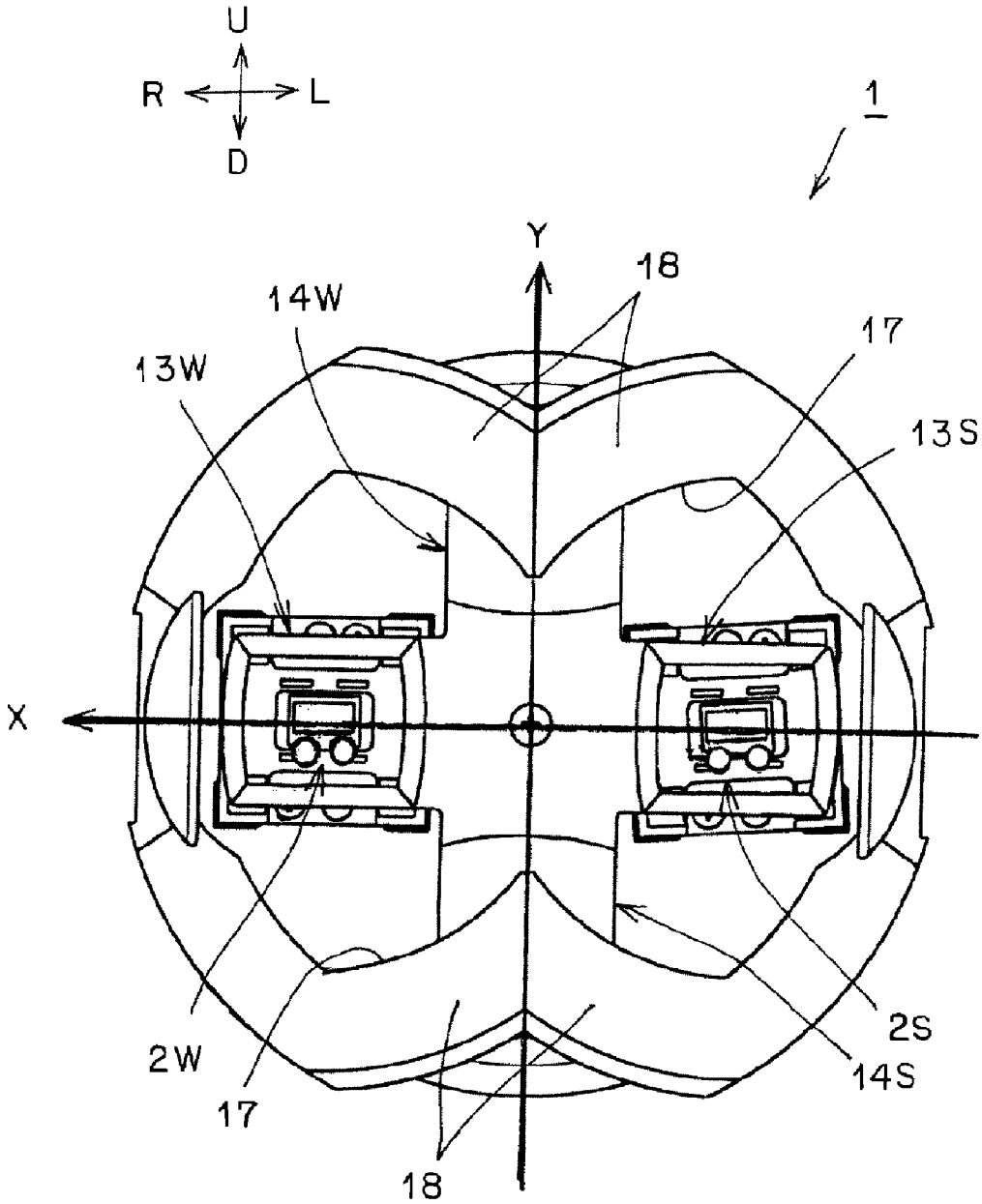
FIG. 20 is a front view of the light shading member, the prism member, and a reflector, showing a state in which the light shading member is positioned in the first location, similarly.
Figure 21:
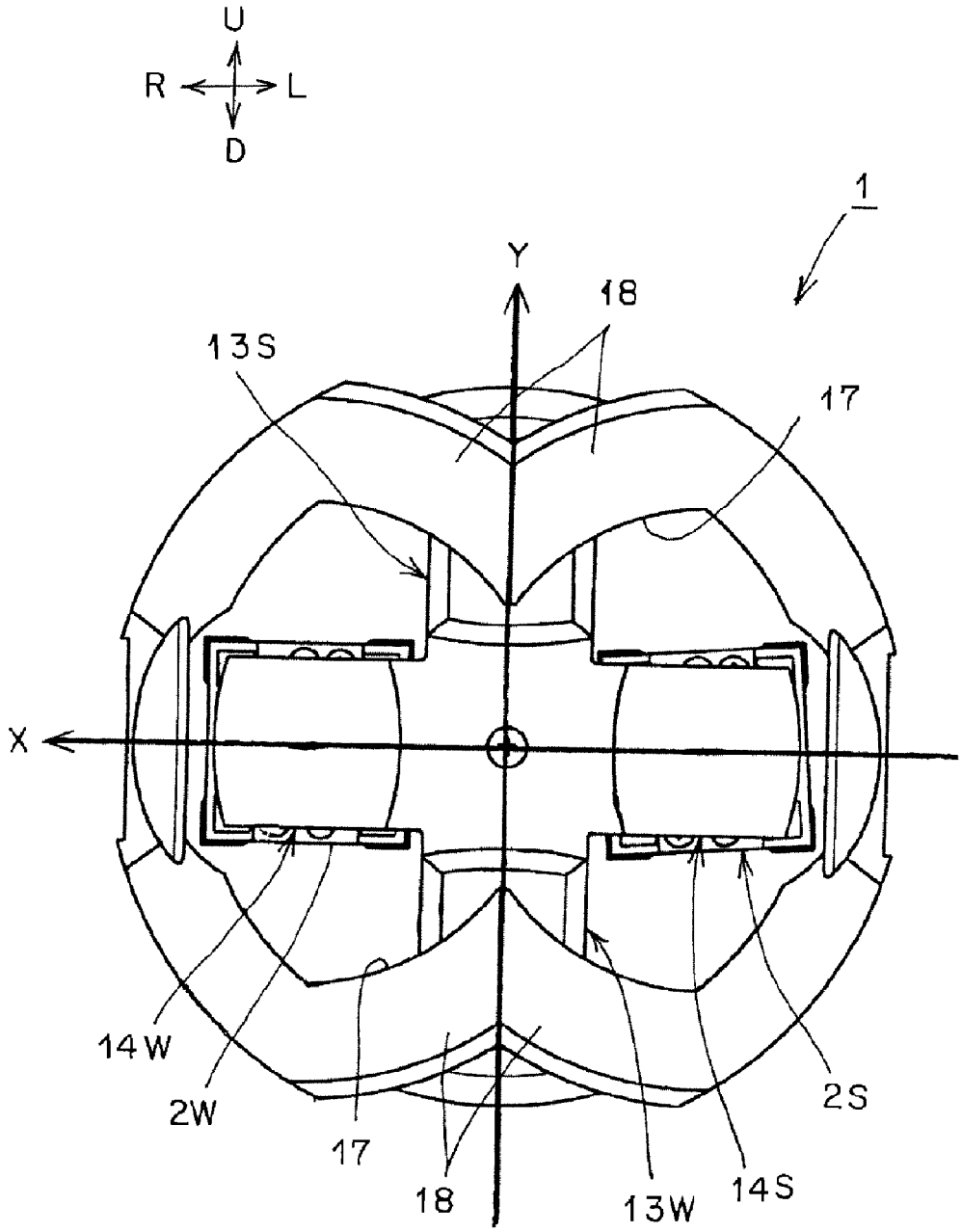
FIG. 21 is a front view of the light shading member, the prism member, and the reflector, showing a state in which the prism member is positioned in the first location, similarly.
Figure 30:
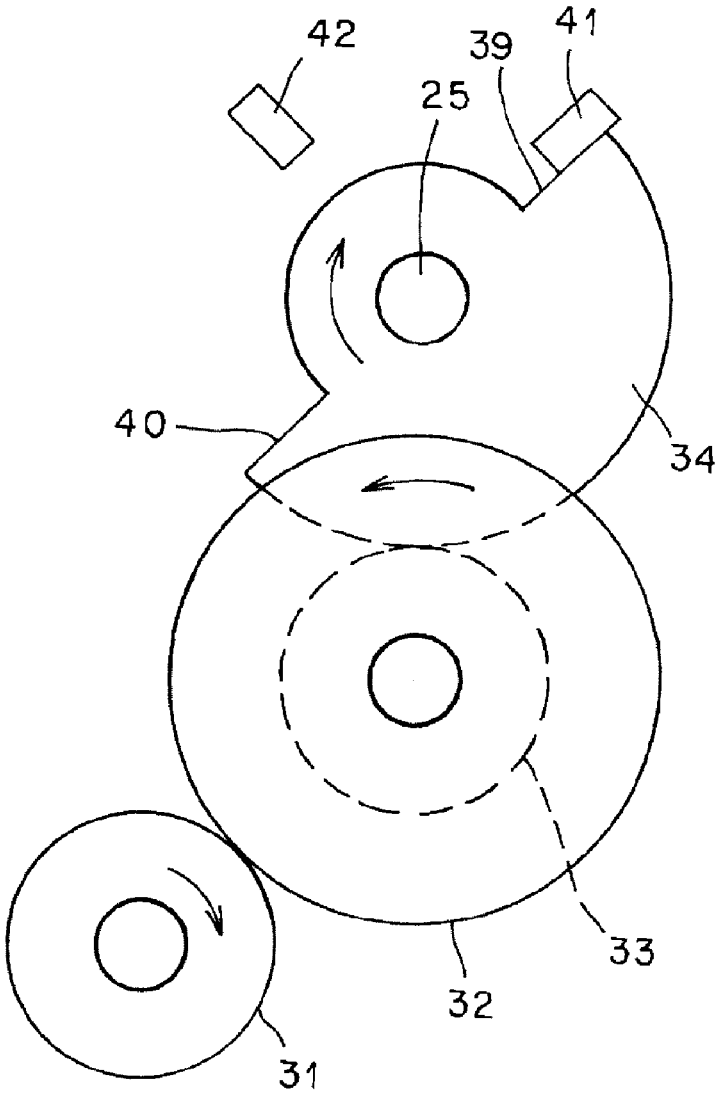
FIG. 30 is an explanatory view showing a state of a deceleration mechanism and a stopper mechanism of the switching device when the light shading member is positioned in the first location, similarly.
Figure 31:
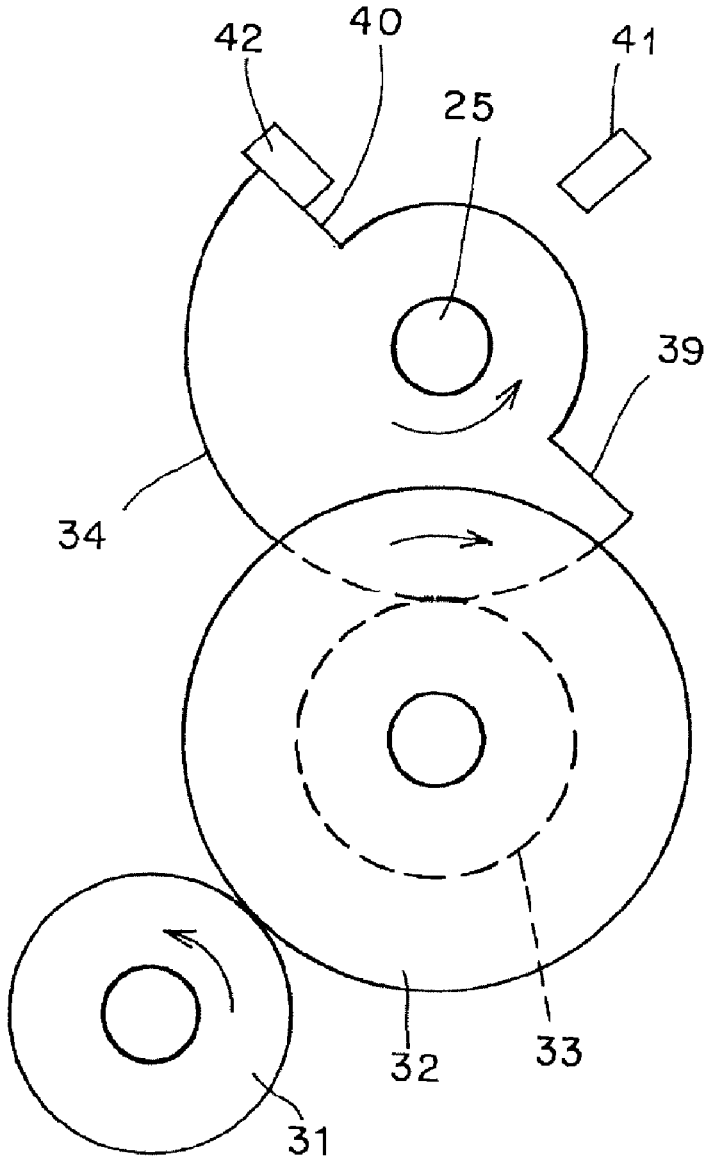
FIG. 31 is an explanatory view showing a state of the deceleration mechanism and the stopper mechanism of the switching device when the prism member is positioned in the first location, similarly.

As shown in FIG. 30, when the first stopper stepped portion 39 of the fourth gear 34 is in abutment against the first stopper convex portion 41 of the foreside housing 27, the light shading members 13S, 13W are positioned in the first location between the semiconductor-type light sources 2S, 2W and the lenses 3S, 3W, as shown in FIGS. 18, 20, and 22. In addition, as shown in FIG. 31, the second stopper stepped portion 40 of the fourth gear 34 is in abutment against the second stopper convex portion 42 of the foreside housing 27, the prism members 14S, 14W are positioned in the first location between the semiconductor-type light sources 2S, 2W and the lenses 3S, 3W, as shown in FIGS. 19, 21, and 23.

The vehicle headlamp 1 of the first embodiment is made up of the abovementioned constituent elements, and hereinafter, functions of these constituent elements will be described.

In a state in which no power is supplied to a motor 29, a first stopper stepped portion 39 of a fourth gear 34 is in abutment against a first stopper convex portion 41 of a foreside housing 27, as shown in FIG. 30, by means of a spring force of a spring 30 of a switching device 15, and as shown in FIGS. 18, 19, and 22, light shading members 13S, 13W are positioned in a first location between semiconductor-type light sources 2S, 2W and lenses 3S, 3W.

In this state, light emitting chips 8S, 8W of the semiconductor-type light sources 2S, 2W of the vehicle headlamp 1 are illuminated to emit light. Afterward, light beams L1, L2 are radiated from the light emitting chips 8S, 8W of the semiconductor-type light sources 2S, 2W. At this time, the light shading members 13S, 13W are positioned in the first location between the semiconductor-type light sources 2S, 2W and the lenses 3S, 3W. Thus, a part L1 of the light beams from the light emitting chips 8S, 8W of the semiconductor-type light sources 2S, 2W passes through openings 19S, 19W of the light shading members 13S, 13W; is incident to incidence surfaces 11S, 11W of the lenses 3S, 3W; and is emitted from emission surfaces 12S, 12W of the lenses 3S, 3W. At this time, projection images I10, 120, 130, 140 of the light emitting chips 8S, 8W are emitted so as not to be convexly curved in an upward direction from cutoff lines CL1, CL2, CL3 on a screen light distribution of a light distribution pattern LP for low beam and so as to be substantially in contact with the cutoff lines CL1, CL2, CL3.

As a result, a spot light distribution SP of a light distribution pattern LP for low beam, shown in FIG. 16, and a diffused light distribution WP of a light distribution pattern LP for low beam, shown in FIG. 17, are obtained respectively, and they are combined with each other, whereby a light distribution pattern LP for low beam, shown in FIG. 32, is obtained.

Figure 33:
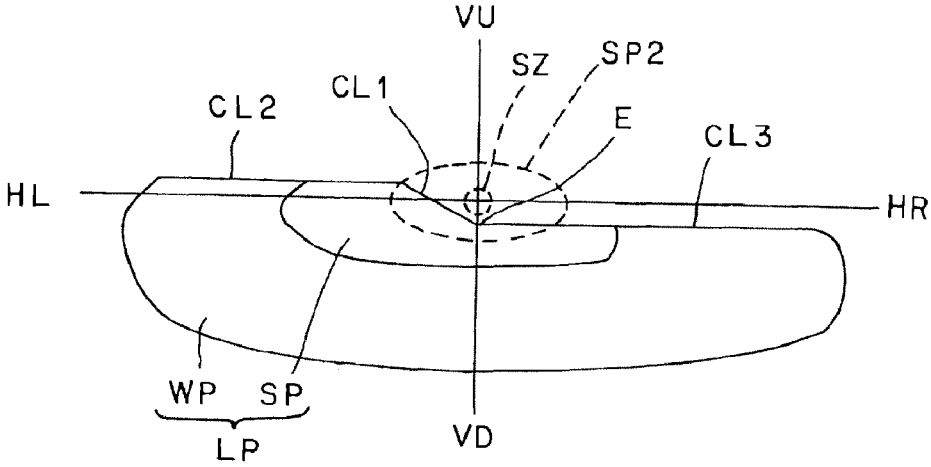
FIG. 33 is an explanatory view showing a state in which a spot light distribution including a main optical axis is illuminated as the light distribution pattern for low beam, of FIG. 32, in a case where a light shading frame of the light shading member is not present, similarly.
Figure 34:
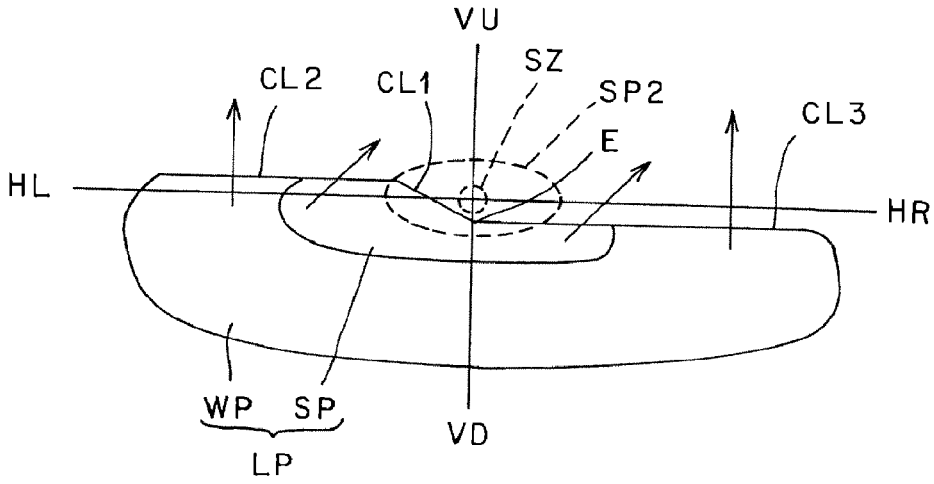
FIG. 34 is an explanatory view showing a state in which the light distribution pattern for low beam, of FIG. 32, is deformed in a course of allowing the prism member to be replaced with the light shading member, similarly.

In addition, since the light shading members 13S, 13W are positioned in the first location between the semiconductor-type light source 2S, 2W and the lenses 3S, 3W, light L2 that is out of lens incidence from the light emitting chips 8S, 8W of the semiconductor-type light sources 2S, 2W, the light being to be incident to a reflecting surface 18 of a reflector 16, is shaded by means of light shading frames 20S, 20W of the light shading members 13S, 13W. As a result, the light distribution pattern LP for low beam, shown in FIG. 32, is reliably obtained In other words, in a case where the light shading frames 20S, 20W of the light shading members 13S, 13W have not existed, a spot light distribution SP2 including a main optical axis SZ (indicated by the dotted lines of FIGS. 33 and 34) is illuminated toward the light distribution pattern LP for low beam, as shown in FIGS. 33 and 34. The spot light distribution SP2 including the main optical axis SZ, as shown in FIGS. 33 and 34, protrudes more upside U than an elbow point E or cutoff lines CL1, CL2, CL3 of the light distribution pattern LP for low beam, and thus, such light distribution is not preferable as a light distribution pattern LP for low beam. However, the vehicle headlamp 1 of the first embodiment becomes capable of shading the light L2 that is out of lens incidence from the light emitting chips 8S, 8W of the semiconductor-type light sources 2S, 2W, the light being to be incident to the reflecting surface 18 of the reflector 16, by means of the light shading frames 20S, 20W of the light shading members 13S, 13W, so that the light distribution pattern LP for low beam, shown in FIG. 32, is obtained.

Next, power is supplied to the motor 29 of the switching device 15. Afterward, the motor 29 is driven, and the first gear 31, the second gear 32, the third gear 33, and the fourth gear 34 then rotate, respectively, in the direction indicated by the arrow shown in FIG. 30. Concurrently, a shaft 25 fixed to the fourth gear 34 rotates against the spring force of the spring 30 in the direction indicated by the arrow, i.e., in the clockwise direction shown in FIG. 30. Due to the rotation of this shaft 25, the light shading members 13S, 13W and prism members 14S, 14W, all of which are integrally structured in a crossing shape mounted on this shaft 25, rotate in the direction indicated by the arrow, i.e., in the clockwise direction shown in FIGS. 18 and 27.

In addition, as shown in FIG. 31, a second stopper stepped portion 40 of the fourth gear 34 of the switching device 15 is in abutment against a second stopper convex portion 42 of the foreside housing 27. Afterward, as shown in FIGS. 19, 21, and 23, the prism members 14S, 14W that have been positioned in a second location so far are positioned in the first location between the semiconductor-type light sources 2S, 2W and the lenses 3S, 3W replaceably with the light shading members 13S, 13W. On the other hand, the light shading members 13S, 13W that have been positioned in the first location between the semiconductor-type light source 2S, 2W and the lenses 3S, 3W so far is repositioned in the second location replaceably with the prism members 14S, 14W.

When the prism members 14S, 14W are positioned in the first location, as shown in FIG. 23, the light L2 that is out of lens incidence from the light emitting chips 8S, 8W of the semiconductor-type light sources 2S, 2W, the light that has been shaded by means of the light shading frames 20S, 20W of the light shading members 13S, 13W so far, is incident to, and is reflected on, the reflecting surface 18 of the reflector 16. As a result, as shown in FIG. 35, the spot light distribution SP2 including the main optical axis SZ is illuminated at or near a crossing point between a horizontal line HL-HR and an upside-downside vertical line VU-VD of a screen.

On the other hand, a part L1 of the light beams from the light emitting chips 8S, 8W of the semiconductor-type light sources 2S, 2W is incident to incidence surfaces 21S, 21W of the prism members 14S, 14W and is emitted from emission surfaces 22S, 22W of the prism members 14S, 14W. Thus, a part L1 of the light beams from the light emitting chips 8S, 8W of the semiconductor-type light sources 2S, 2W is incident to incidence surfaces 11S, 11W of the lenses 3S, 3W and is emitted from emission surfaces 12S, 12W of the lenses 3S, 3W in a state in which reference focal points FS, FW of the lenses 2S, 2W are virtually moved to virtual lens reference focal points FS1, FW1.

As a result, as shown in FIG. 34, the spot light distribution SP of the light distribution pattern LP for low beam moves to the upside U and to the opposite lane side (right side R), namely, to the main optical axis SZ of the light distribution pattern HP for high beam. The diffused light distribution WP of the light distribution pattern LP for low beam moves to the upside U. Further, the elbow point E and cutoff lines CL1, CL2, CL3, of the light distribution pattern LP for low beam, smoothly widen to the upside U and the opposite lane side (right side R), namely to the main optical axis SZ or to the upside U, of the light distribution pattern HP for high beam. In this manner, spot light distribution SP or diffused light distribution WP of the light distribution pattern LP for low beam, shown in FIG. 32, is switched to spot light distribution SP1 or diffused light distribution WP of the light distribution pattern HP for high beam, shown in FIG. 35.

Power supply to the motor 29 of the switching device 15 is then shut down. Afterward, due to the spring force of the spring 30, the first gear 31, the second gear 32, the third gear 33, and the fourth gear 34 rotate, respectively, in the direction indicated by the arrow shown in FIG. 31. Concurrently, the shaft 25 that is fixed to the fourth gear 34 rotates in the direction indicated by the arrow, i.e., in the counterclockwise direction shown in FIG. 31. Due to the rotation of the shaft 25, the light shading members 13S, 13W and prism members 14S, 14W integrally structured in a crossing shape mounted on the shaft 25 rotate in the direction indicated by the arrow, i.e., in the clockwise direction shown in FIGS. 19 and 27.

In addition, as shown in FIG. 30, the first stopper stepped portion 39 of the fourth gear 34 of the switching device 15 is in abutment against the first stopper convex portion 41 of the foreside housing 27. Afterward, as shown in FIGS. 18, 20, and 22, the light shading members 13S, 13W that have been positioned in the second location so far are positioned in the first location between the semiconductor-type light sources 2S, 2W and the lenses 3S, 3W replaceably with the prism members 14S, 14W. On the other hand, the prism members 14S, 14W that have been positioned in the first location between the semiconductor-type light sources 2S, 2W and the lenses 3S, 3W so far are positioned in the second location replaceably with the light shading members 13S, 13W.

In addition, in a state in which the prism members 14S, 1W are positioned in the first location or when they are rotating from the second location to the first location, if power supply to the motor 29 of the switching device 15 is shut down (if power supply is shut down), the light shading members 13S, 13W are restored to the first location by means of the spring force of the spring 30. Thus, the light distribution pattern HP for high beam, shown in FIG. 35, can be switched to the light distribution pattern LP for low beam, shown in FIG. 32. In this manner, a fail-safe function works.

In such a manner as described above, the light distribution pattern LP for low beam, shown in FIG. 32, and the light distribution pattern HP for high beam, shown in FIG. 35, are illuminated toward a forward direction of a vehicle.

The vehicle headlamp 1 of the first embodiment is made up of the abovementioned constituent elements and functions, and hereinafter, advantageous effect(s) thereof will be described.

In the vehicle headlamp 1 of the first embodiment, when the light shading members 13S, 13W have been replaceably positioned in the first location and the prism members 14S, 14W have been replaceably positioned in the second location by means of the switching device 15, if the light emitting chips 8S, 8W of the semiconductor-type light sources 2S, 2W are illuminated to emit light, a part L1 of the light beams radiated from the light emitting chips 8S, 8W passes through the lenses 3S, 3W and is illuminated toward the forward direction of the vehicle, as a light distribution pattern LP for low beam, having the cutoff lines CL1, CL2, CL3. At this time, the light L2 that is out of lens incidence from the light emitting chips 8S, 8W of the semiconductor-type light sources 2S, 2W, the light being to be incident to the reflecting surface 18 of the reflector 16, is shaded by means of the light shading members 13S, 13W. In addition, when the prism members 14S, 14W have been replaceably positioned in the first location and the light shading members 13S, 13W have been replaceably positioned in the second location by means of the switching device 15, if the light emitting chips 8S, 8W of the semiconductor-type light sources 2S, 2W are illuminated to emit light, a part L1 of the light beams radiated from the light emitting chips 8S, 8W is illuminated toward the forward direction of the vehicle, as a light distribution pattern HP for high beam, after passing through the prism members 14S, 14W and the lenses 3S, 3W in a state in which the reference focal points FS, FW have been virtually moved to the virtual reference focal points FS1, FW1 by means of the prism members 14S, 14W. At this time, the light L2 that is out of lens incidence from the light emitting chips 8S, 8W of the semiconductor-type light sources 2S, 2W is incident to, and is reflected on, the reflecting surface 18 of the reflector 16, without being hindered by the prism members 14S, 14W, and illuminates the forward direction of the vehicle as the spot light distribution SP2 including a main optical axis SZ of a light distribution pattern HP for high beam In this manner, the vehicle headlamp 1 of the first embodiment employs the semiconductor-type light sources 2S, 2W as light sources, and allows a light distribution pattern LP for low beam, having the cutoff lines CL1, CL2, CL3, and a light distribution pattern HP for high beam, to be replaceably illuminated to the forward direction of the vehicle.

Further, the vehicle headlamp 1 of the first embodiment is made of: the semiconductor-type light sources 2S, 2W; the lenses 3S, 3W; the reflector 16; the light shading members 13S, 13W and prism members 14S, 14W that are integrally structured with each other; and the switching device 15. Thus, a need for a second light source unit for a light distribution pattern for high beam is eliminated, and the number of components is reduced, in comparison with the conventional vehicle headlamp, and downsizing, weight reduction, and cost reduction can be achieved accordingly.

Moreover, the vehicle headlamp 1 of the first embodiment allows the reference focal points FS, FW of the lenses 3S, 3W to be virtually moved to the virtual reference focal points FS1, FW1 by means of the prism members 14S, 14W, so that the light distribution pattern emitted from the lenses 3S, 3W can be reliably switched from the light distribution pattern LP for low beam, having the cutoff lines CL1, CL2, CL3, to the light distribution pattern HP for high beam. Further, the vehicle headlamp 1 of the first embodiment allows the spot light distribution SP2 including the main optical axis SZ of the light distribution pattern HP for high beam, to be obtained by means of the reflecting surface 18 of the reflector 16, so that the light distribution pattern HP for high beam, having the sufficient maximum luminous intensity, is obtained.

In addition, in the vehicle headlamp 1 of the first embodiment, when the light shading members 13S, 13W are positioned in the first location, while light L1 radiated from the light emitting chips 8S, 8W of the semiconductor-type light sources 2S, 2W is incident from the incidence surfaces 11S, 11W of the lenses 3S, 3W and is emitted from the emission surfaces 12S, 12W of the lenses 3W, 3W, projection images 110, 120, 130, 140 of the light emitting chips 8S, 8W, which are substantially in contact with the cutoff lines CL1, CL2, CL3, are emitted so as not to be convexly curved in an upward direction from the cutoff lines CL1, CL2, CL3 on the screen light distribution of the light distribution pattern LP for low beam, having the cutoff lines CL1, CL2, CL3, so that the light distribution pattern LP for low beam, having the cutoff lines CL1, CL2, CL3, can be reliably obtained. In addition, in the vehicle headlamp 1 of the first embodiment, when the prism members 14S, 14W are positioned in the first location, the reference focal points FS, FW of the lenses 3S, 3W virtually move to the virtual reference focal points FS1, FW1 in the direction of upside U or right oblique upside, so that a portion in high luminous intensity zone of the light distribution pattern LP for low beam, having the cutoff lines CL1, CL2, CL3, moves in the upside U or right oblique upside direction, and becomes a portion in high luminous intensity zone of the light distribution pattern HP for high beam; and a portion of the cutoff lines CL1, CL2, CL3 of the light distribution pattern LP for low beam moves smoothly widely in the direction of the upside U or right oblique upside, and becomes an upside portion of the light distribution pattern HP for high beam. In this manner, the vehicle headlamp 1 of the first embodiment becomes capable of replaceably obtaining a light distribution pattern LP for low beam, having good cutoff lines CL1, CL2, CL3, and a good light distribution pattern HP for high beam.

Moreover, the vehicle headlamp 1 of the first embodiment allows the light distribution pattern LP for low beam, having the cutoff lines CL1, CL2, CL3, to be obtained by means of the semiconductor-type light sources 2S, 2W and the lenses 3S, 3W fixed to the heat sink member 4, so that there does not vary a portion in high luminous intensity in the vicinity of the cutoff lines CL1, CL2, CL3 of the light distribution pattern LP for low beam, having the cutoff lines CL1, CL2, CL3, i.e., an important portion (point). In addition, the spot light distribution SP2, including the main optical axis SZ of the light distribution pattern HP for high beam, is obtained by means of the semiconductor-type light sources 2S, 2W and the reflecting surface 18 of the reflector 16, fixed to the heat sink member 4, so that there does not vary a portion of the spot light distribution SP2, including the main optical axis SZ of the light distribution pattern HP for high beam, i.e., an important portion (point). In this manner, the vehicle headlamp 1 of the first embodiment allows desired light distribution characteristics to be obtained as per a light distribution design.

Further, the vehicle headlamp 1 of the first embodiment allows the spot light distribution SP to be obtained by means of: the semiconductor-type light source 2S, the lens 3S, the light shading member 13S, and the prism member 14S for spot light distribution; and the diffused light distribution WP to be obtained by means of the semiconductor-type light source 2W, the lens 3W, the light shading member 13W, and the prism member 14W for diffused light distribution. Thus, the vehicle headlamp 1 of the first embodiment is suitable to obtain the light distribution pattern LP for low beam, having the cutoff lines CL1, CL2, CL3, and the light distribution pattern HP for high beam, since a light distribution pattern is obtained in such a manner that the luminous intensity (illumination intensity, amount of light) of a central portion is the highest and the luminous intensity (illumination intensity, amount of light) becomes gradually lowered from the central portion to a peripheral portion. Moreover, the vehicle headlamp 1 of the first embodiment allows functions of the semiconductor-type light sources, lenses, light shading members, and prism members to be shared by: the semiconductor-type light source 2S, the lens 3S, the light shading member 13S, and the prism member 14S having a spot light distribution function; and the semiconductor-type light source 2W, the lens 3W, the light shading member 13W, and the prism member 14W having a diffused light distribution, respectively, so that even if light emission outputs of the semiconductor-type light sources 2S, 2W are small, it is possible to obtain: a light distribution pattern LP for low beam, having luminous intensity (illumination intensity, amount of light) of sufficient light distribution patterns (the light distribution pattern LP for low beam, having the cutoff lines CL1, CL2, CL3, and the light distribution pattern HP for high beam), in particular a spot light distribution of luminous intensity (illumination intensity, amount of light) which is sufficient at the central portion of the light distribution patterns (the light distribution pattern LP for low beam, having the cutoff lines CL1, CL2, CL3, and the light distribution pattern HP for high beam).

Furthermore, the vehicle headlamp 1 of the embodiment allows a long side of the light emitting chip 8S of the semiconductor-type light source 2S for slot light distribution, to be tilted with respect to the X axis as a horizontal axis and a long side of the light emitting chip 8W of the semiconductor-type light source 2W for diffused light distribution to be parallel to the X axis as a horizontal axis, so that: the spot light distribution SP can be taken along the oblique cutoff line CL1; and the diffused light distribution WP can be taken along the upper horizontal cutoff line CL2 and the lower cutoff line CL3. Therefore, the vehicle headlamp 1 of the embodiment is suitable to obtain a light distribution pattern having cutoff lines (Z cutoff lines) made of: the upper horizontal cutoff line CL2 at the cruising lane side (left side L); the oblique cutoff line CL1 at the cruising lane side (left side L); and the lower horizontal cutoff line CL3 at the opposite lane side (right side R), for example, the light distribution pattern LP for low beam, and moreover, a light distribution pattern having the Z cutoff lines, for example, the light distribution pattern LP for low beam can be reliably obtained. Moreover, in the vehicle headlamp 1 of the first embodiment, the long side of the light emitting chip 8S of the semiconductor-type light source 2S for spot light distribution is tilted with respect to the X-axis serving as a horizontal axis and the long side of the light emitting chip 8W of the semiconductor-type light source 2W for diffused light distribution is parallel to the X-axis serving as a horizontal axis, so that the spot light distribution SP can be taken along the oblique cutoff line CL1 and the diffused light distribution WP can be taken along the upper horizontal cutoff line CL2 and the lower horizontal cutoff line CL3, making it possible to reliably obtain the light distribution pattern LP for low beam having the Z cutoff lines.

Second Embodiment

Figure 36:
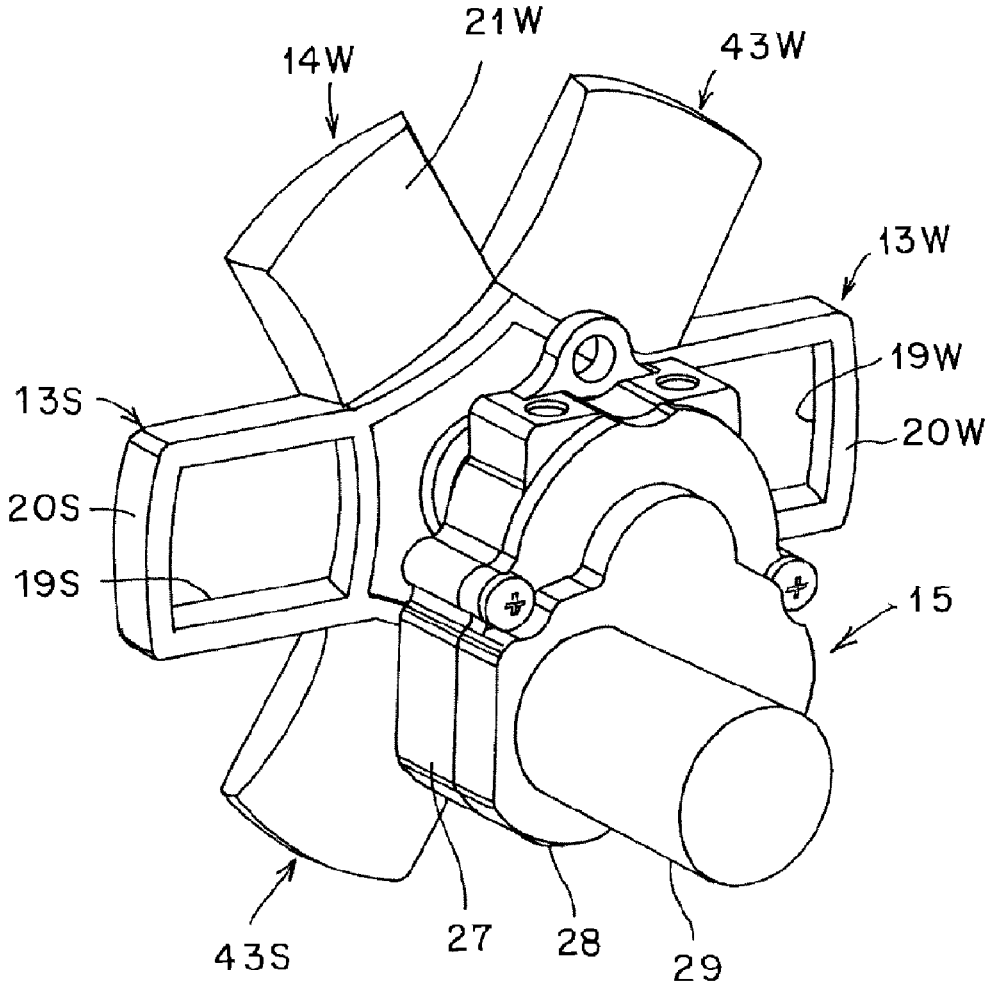
FIG. 36 is a perspective view of a light shading member and a prism member, showing a second embodiment of a vehicle headlamp according to the present invention, similarly.
Figure 37:
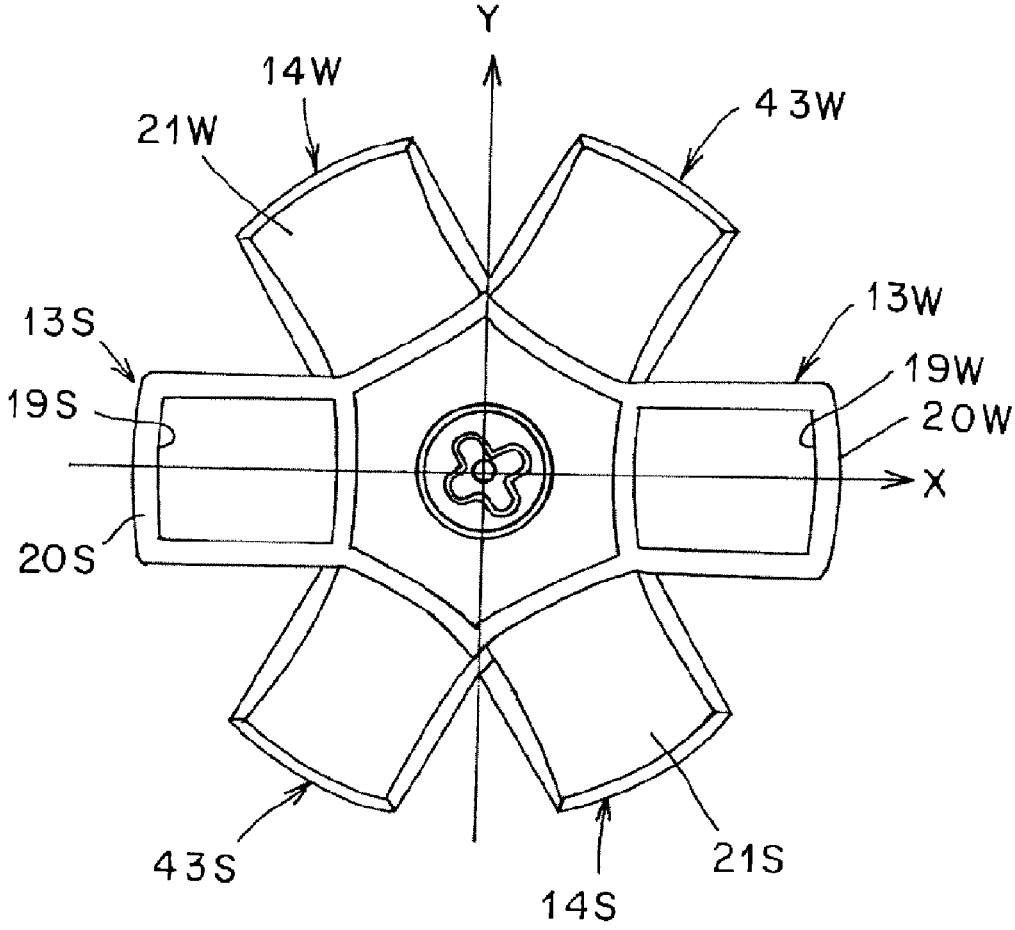
FIG. 37 is a rear view of the light shading member and the prism member, showing a state in which the light shading member is positioned in the first location, similarly.
Figure 38:
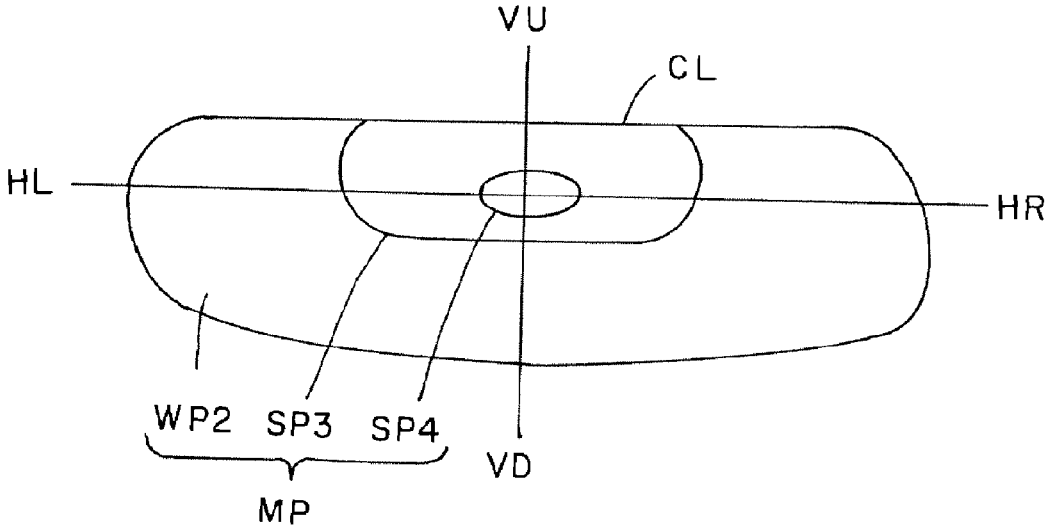
FIG. 38 is an explanatory view showing a light distribution pattern for mid-beam, which is obtained when a prism member for mid-beam is positioned in the first location, similarly.

FIGS. 36 to 38 show a second embodiment of a vehicle headlamp according to the present invention. Hereinafter, the vehicle headlamp of the second embodiment will be described. In the figures, like constituent elements shown in FIGS. 1 to 35 are designated by like reference numerals.

The vehicle headlamp of the second embodiment is intended to illuminate: a light distribution pattern LP for low beam, shown in FIG. 32; a light distribution pattern HP for high beam, shown in FIG. 35; and a light distribution pattern MP for mid beam, shown in FIG. 38, toward a forward direction of a vehicle. The light distribution pattern MP for mid beam, shown in FIG. 38, has a substantially horizontal cutoff line CL. The cutoff line CL of the light distribution pattern MP for mid beam, shown in FIG. 38, is positioned more upside than cutoff lines CL1, CL2, CL3 of the light distribution pattern LP for low beam, shown in FIG. 32.

The vehicle headlamp of the second embodiment is provided with: prism members for high beam, forming the light distribution pattern HP for high beam, i.e., prism members 14S, 14W of the vehicle headlamp 1 of the first embodiment; and a prism members 43S, 43W for mid beam, forming the light distribution pattern MP for mid beam.

The prism members 43S, 43W for mid beams are constituted in a manner which is substantially similar to that of the prism members 14S, 14W for high beam. The prism members 43S, 43W for mid beam are integrally structured in a six-petaline shape together with the prism members 14S, 14W for high beam and the light shading members 13S, 13W. The prism members 43S, 43W for mid beam are provided with: an incidence surface to which light L1 from light emitting chips 8S, 8W of the semiconductor-type light sources 2S, 2W is incident; and an emission surface from which the light incident to the prism members 14S, 14W is emitted.

An emission surface W of a respective one of the prism members 43S, 43W for mid beams is made of a conical curved face (a curve such as an ellipse, a circle, a parabola, or a hyperbola, or alternatively, a surface of the second order such as a flat face, for example). In the embodiment, this emission surface is made of a flat face.

The incidence surface of the mid-beam prism member 43S for spot light distribution is made of a free curved face controlled to be curved so as to virtually move a reference focal point FS of the lens 3S for spot light distribution in a right oblique upside direction (between the virtual lens reference focal point FS1 of FIG. 25 and the centers OS, OW of the light emitting chips 8S, 8W and the reference focal points FS, FW of the lenses 3S, 3W). The free curved face of the incidence surface of the mid-beam prism member 43S for spot light distribution has a convex portion which is convexly curved toward the semiconductor-type light source 2S for spot light distribution. A peak of the convex portion is present at a portion of the first quadrant, where the first quadrant, the second quadrant, the third quadrant, and the fourth quadrant divided by a vertical axis and a horizontal axis orthogonal to each other, passing through an origin, are defined with the reference axis ZS of the lens 3S for spot light distribution serving as the origin in a rear view (the state seen from the backside B).

On the other hand, the incidence surface of the mid-beam prism member 43W for diffused light distribution is made of a free curved face controlled to be curved so as to move the reference focal point FW of the lens 3W for diffused light distribution virtually to the upside direction (between the virtual lens reference focal point FS 1 of FIG. 25 and the centers OS, OW of the light emitting chips 8S, 8W and the reference focal points FS, FW of the lenses 3S, 3W). The free curved face of the incidence surface of the mid-beam prism member 43W for diffused light distribution has a convex portion which is convexly curved toward the semiconductor-type light source 2W for diffused light distribution. A peak of the convex portion is present at a portion spreading across the first quadrant and the second quadrant, where the first quadrant, the second quadrant, the third quadrant, and the fourth quadrant, divided by a vertical axis and a horizontal axis orthogonal to each other, passing through an origin, are defined with the reference axis ZW of the lens 3W for diffused light distribution serving as the origin in a rear view (the state seen from the backside B).

The prism members 43S, 43W for mid beams are disposed to be movable between the first location and a respective one of second and third new positions replaceably with the prism members 14S, 14W for high beam and the light shading members 13S, 13W, respectively. When the prism members 43S, 43W for mid beams are positioned in the first location, they do not hinder the light L2 that is out of lens incidence from the light emitting chips 8S, 8W of the semiconductor-type light sources 2S, 2W from being incident to the reflecting surface 18, allowing a part L1 of the light beams from the light emitting chips 8S, 8W of the semiconductor-type light sources 2S, 2W to be incident to the incidence surfaces 115, 11W of the lenses 3S, 3W in a state in which the reference focal points FS, FW of the lenses 3S, 3W are virtually moved to the virtual lens reference focal point (the virtual lens focal point between the virtual focal point FS1 of FIG. 25 and the centers OS, OW of the light emitting chips 8S, 8W and the reference focal points FS, FW of the lenses 3S, 3W).

The prism members 43S, 43W for mid beams; the prism members 14S, 1W for high beams; and the light shading members 13S, 13W are disposed to be replaceably movable among the first location, the second location, and the third position by means of the switching device 15. The switching device 15 is intended to rotate the prism members 43S, 43W for mid beams, the prism members 14S, 14W for high beams, and the light shading members 13S, 13W by 60 degrees.

The vehicle headlamp of the second embodiment is made of the constituent elements as described above. The prism members 43S, 43W for mid beams, the prism members 14S, 14W for high beams, and the light shading members 13S, 13W are rotated by 60 degrees by means of the switching device 15, and are replaceably positioned in the first location, allowing the light distribution pattern MP for mid beam, shown in FIG. 38, the light distribution pattern HP for high beam, shown in FIG. 35, and the light distribution pattern LP for low beam, shown in FIG. 32, to be illuminated to the forward direction of the vehicle.

The light distribution pattern MP for mid beam, shown in FIG. 38, is formed by combining: a diffused light distribution WP2 formed by means of the semiconductor-type light source 2W, the lens 3W, the light shading member 13W, and the mid-beam prism member 43W, having a diffused light distribution function; a spot light distribution SP3 formed by means of the semiconductor-type light source 2S, the lens 3S, the light shading member 13S, and the prism member 43S for mid beam, having a spot light distribution function; and a spot light distribution SP4 with high luminous intensity, formed by means of the reflecting surface 18 of the reflector 16.

The first and second embodiments described a case in which the light distribution patterns LP, HP, and MP for low, high, and mid beams are illuminated toward the forward direction of the vehicle. However, in the present invention, any light distribution pattern other than the light distribution patterns LP, HP, and MP for low, high, and mid beams, for example, a light distribution pattern for expressway or a light distribution pattern for fog lamp may be illuminated toward the forward direction of the vehicle.

In addition, the first and second embodiments described a case in which cutoff lines of the light distribution pattern LP for low beam are the Z cutoff lines made of an oblique cutoff line CL1, an upper horizontal cutoff line CL2, and a lower horizontal cutoff line CL3. However, in the present invention, there may be cutoff lines made of other than the Z cutoff lines, for example, merely horizontal cutoff lines or cutoff lines made of an oblique cutoff line at the cruising lane side and a horizontal cutoff line at the opposite lane side.

Further, the first and second embodiments described the vehicle headlamp 1 for left-side cruising lane. However, the present invention is applicable to a vehicle headlamp for right-side cruising lane as well.

Furthermore, the first and second embodiments described a case in which the semiconductor-type light sources 2S, 2W and lenses 3S, 3W for spot light distribution and diffused light distribution are disposed in juxtaposition with each other in the X-axis direction. However, in the present invention, the semiconductor-type light sources 2S, 2W and the lenses 3S, 3W for spot light distribution and diffused light distribution may be positioned in a vertical direction, may be disposed in a upside-downside or left-right oblique direction, or may be disposed alternately in forward/backward directions. In this case, the light shading member 13S and prism member 14S for spot light distribution; and the prism member 43S for mid beam; the light shading member 13W and prism member 14W for diffused light distribution; and the prism member 43W for mid beam, are needed to be replaceably positioned respectively independently, among the first, second, and third positions, by means of a switching device.

Still furthermore, the first and second embodiments described a case in which the vehicle headlamp is comprised of: a lamp unit made of the semiconductor-type light source 2S, the lens 3S, the light shading member 13S, prism member 14S, and mid-beam prism member 43S for spot light distribution; and a lamp unit made of the semiconductor-type light source 2W, the lens 3W, the light shading member 13W, the prism member 14W, and the mid-beam prism member 43W for diffused light distribution. However, in the present invention, a light distribution pattern having one or more cutoff lines may be formed by means of one lamp unit made of one semiconductor-type light source, one lens, one light shading member, one prism member, and one mid-beam prism member, or alternatively, a light distribution pattern having one or more cutoff lines may be formed by means of three or more lamp units.

What is claimed is:

1. A vehicle headlamp, comprising:

(i) a semiconductor-type light source having a light emitting chip shaped like a planar rectangle;

(ii) a lens for illuminating a part of light is emitted from the light emitting chip of the semiconductor-type light source toward a forward direction of a vehicle, as a light distribution pattern having one or more cutoff lines;

(iii) a reflector having a reflecting surface for forwardly reflecting the light emitted from the light emitting chip of the semiconductor-type light source, excepting light incident to the lens, as a spot light distribution including a main optical axis of a light distribution pattern for high beam;

(iv) a light shading member which is disposed to be movable between a first location and a second location, for disallowing a part of the light emitted from the light emitting chip of the semiconductor-type light source, to be hindered from being incident to the lens and for shading light that is out of incidence to the lens from the light emitting chip of the semiconductor-type light source, the light being incident to the reflecting surface, when the light shading member is positioned in the first location;

(v) a prism member which is integrally structured together with the light shading member and is disposed to be movable between the first and second locations replaceably with the light shading member, for disallowing the light that is out of incidence to the lens and is emitted from the light emitting chip of the semiconductor-type light source, to be hindered from being incident to the reflecting surface, when the prism member is positioned in the first location, and for allowing a part of the light emitted from the light emitting chip of the semiconductor-type light source, to be incident to the lens in a state in which a reference focal point of the lens is virtually moved; and (vi) a switching device for replaceably switching the light shading member and the prism member that are integrally structured with each other, between the first location and the second location, thereby switching a current light distribution pattern to a respective one of a light distribution pattern having one or more cutoff lines and a light distribution pattern for high beam.

2. The vehicle headlamp according to claim 1, wherein:

a center of the light emitting chip is positioned at or near a reference focal point of the lens and is positioned on or near a reference axis of the lens;

a light emitting surface of the light emitting chip is oriented in a forward direction of the reference axis of the lens;

a long side of the light emitting chip is parallel to a horizontal axis orthogonal to the reference axis of the lens or is tilted with respect to the horizontal axis;

an incidence surface of the lens is made of a conical curved face;

an emission surface of the lens is made of a free curved face controlled to be curved so that: a projection image of the light source, which is emitted from the emission face of the lens, is disallowed to protrude from the cutoff line on a screen light distribution of the light distribution pattern; and a part of the projection image of the light source is substantially in contact with the cutoff lines;

the free curved face of the emission surface of the lens is made of a free curved face on which: with the reference axis of the lens serving as an origin in a front view, a first quadrant, a second quadrant, a third quadrant, and a fourth quadrant, divided by a vertical axis and a horizontal axis orthogonal to each other, passing through the origin, are defined; and in a case where the first quadrant and the second quadrant are compared with each other in a symmetrical position relationship with respect to the vertical axis, a portion of about ⅓ or more of the first quadrant is higher than the second quadrant in the forward direction of the reference axis of the lens, and in a case where the first quadrant and the forth quadrant are compared with each other in a symmetrical position relationship with respect to the horizontal axis, the portion of about ⅓ or more of the first quadrant is lower than the fourth quadrant in the forward direction of the reference axis of the lens;

the emission surface of the prism member is made of a conical curved face;

the incidence surface of the prism member is made of a free curved face controlled to be curved so as to virtually move the reference focal point of the lens to an upside or an oblique upside; and the free curved face of the incidence surface of the prism member has a convex portion which is convexly curved toward the semiconductor-type light source and a peak of the convex portion is present at a portion spreading across the first quadrant and the second quadrant or at a portion of the first quadrant, in a case where, with the reference axis of the lens serving as an origin in a rear view, the first quadrant, the second quadrant, the third quadrant, and the fourth quadrant, divided by the vertical axis and the horizontal axis orthogonal to each other, passing through the origin, are defined.

3. The vehicle headlamp according to claim 1, wherein:

the semiconductor-type light source, the lens, the light shading member, and the prism member comprise:

a semiconductor-type light source, a lens, a light shading member, and a prism member for spot light distribution, which serve to implement spot light distribution at a substantially central portion on a screen light distribution of the light distribution pattern having the cutoff lines and the light distribution pattern for high beam; and a semiconductor-type light source, a lens, a light shading member, and a prism member for diffused light distribution, which serve to implement diffused light distribution of an entire portion on the screen light distribution of the light distribution pattern having the cutoff lines and the light distribution pattern for high beam.

4. The vehicle headlamp according to claim 3, wherein:

the cutoff lines are made of an oblique cutoff line with an upward gradient from an elbow point to a cruising lane side; an upper horizontal cutoff line which is horizontal from the oblique cutoff line to the cruising lane side; and a lower horizontal cutoff line which is horizontal from the elbow point to an opposite lane side;

a long side of the light source of the semiconductor-type light source for spot light distribution is rotated by about 5 degrees, and is tilted with respect to the horizontal axis so that the cruising lane side is upward than the opposite lane side with respect to the horizontal axis around the reference axis of the lens;

a long side of the light source of the semiconductor-type light source for diffused light distribution is parallel to the horizontal axis;

a projection image of the light source, which is emitted from the first quadrant and the fourth quadrant of the emission surface of a respective one of the lens for spot light distribution and the lens for diffused light distribution, mainly forms a light distribution on the cruising lane side from the elbow point on the screen light distribution of the light distribution pattern having the cutoff lines; and a projection image of the light source, which is emitted from the second quadrant and the third quadrant of the emission surface of a respective one of the lens for spot light distribution and the lens for diffused light distribution, mainly form a light distribution on the opposite lane side from the elbow point on the screen light distribution of the light distribution pattern having the cutoff lines.

5. The vehicle headlamp according to claim 1, wherein:

the prism member comprises:

a prism member for high beam, forming the light distribution pattern for high beam; and other one or more prism members for light distribution pattern, forming other one or more light distribution patterns, and the switching device is a switching device for replaceably switching the light shading member and the prism member for high beam, which is integrally structured, and said other one or more prism members for light distribution pattern, between a first location and a second location, thereby switching a current light distribution pattern to a light distribution pattern having one or more cutoff lines, a light distribution pattern for high beam, or alternatively, other one or more light distribution patterns.

6. A vehicle headlamp, comprising:

(i) a light source;

(ii) a lens for illuminating a part of light emitted from the light source toward a forward direction of a vehicle, as a light distribution pattern having one or more cutoff lines;

(iii) a reflector for reflecting the light emitted from the light source, the light being out of incidence to the lens, to the forward direction of the vehicle, as a light distribution of a light distribution pattern for high beam;

(iv) a light shading member which is constituted to be movable between a first location in which the light shading member is disposed between the light source and the lens and a second location in which the light shading member is not disposed therebetween; and (v) a prism member which is disposed to be movable between the first location and the second location replaceably with the light shading member, wherein:

when the light shading member is positioned in the first location, the light shading member allows a part of the light emitted from the light source to be incident to the lens, and shades light that is out of incidence to the lens from the light source, the light being incident to the reflector, whereby the light incident to the lens is illuminated to the forward direction of the vehicle, as the light distribution pattern having the cutoff lines; and when the prism member is positioned in the first location, the prism member is adapted to illuminate toward the forward direction of the vehicle:

the light obtained by allowing the part of the light emitted from the light source to be incident to the lens in a state in which a reference focal point of the lens is virtually moved by means of the prism member; and the light obtained by allowing the light that is out of incidence to the lens from the light source to be reflected by means of reflector, as a light distribution of the light distribution pattern for high beam.

7. The vehicle headlamp according to claim 6, further comprising a switching device for replaceably switching the light shading member and the prism member between the first location and the second location, wherein:

the light emitted from the light source is switched to a respective one of a light distribution of the light distribution pattern having the cutoff lines and a light distribution of the light distribution pattern for high beam, in response to an operation of the switching device switching the light shading member and the prism member of be disposed in the first location, and the switched light is illuminated to the forward direction of the vehicle.

8. The vehicle headlamp according to claim 6, wherein:

a center of the light source is positioned at or near a reference focal point of the lens and is positioned on or near a reference axis of the lens;

a light emitting surface of the light source is oriented in a forward direction of the reference axis;

a long side of the light source is parallel to a horizontal axis orthogonal to the reference axis of the lens or is tilted with respect to the horizontal axis;

an incidence surface of the lens is made of a conical curved face;

an emission surface of the lens is made of a free curved face controlled to be curved so that: a projection image of the light source, which is emitted from the emission face of the lens, is disallowed to protrude from the cutoff line on a screen light distribution of the light distribution pattern; and a part of the projection image of the light source is substantially in contact with the cutoff lines;

the free curved face of the emission surface of the lens is made of a free curved face on which: with the reference axis of the lens serving as an origin in a front view, a first quadrant, a second quadrant, a third quadrant, and a fourth quadrant, divided by a vertical axis and a horizontal axis orthogonal to each other, passing through the origin, are defined; and in a case where the first quadrant and the second quadrant are compared with each other in a symmetrical position relationship with respect to the vertical axis, a portion of about ⅓ or more of the first quadrant is higher than the second quadrant in the forward direction of the reference axis of the lens, and in a case where the first quadrant and the forth quadrant are compared with each other in a symmetrical position relationship with respect to the horizontal axis, the portion of about ⅓ or more of the first quadrant is lower than the fourth quadrant in the forward direction of the reference axis of the lens;

the emission surface of the prism member is made of a conical curved face;

the incidence surface of the prism member is made of a free curved face controlled to be curved so as to virtually move the reference focal point of the lens to an upside or an oblique upside; and the free curved face of the incidence surface of the prism member has a convex portion which is convexly curved toward the semiconductor-type light source and a peak of the convex portion is present at a portion spreading across the first quadrant and the second quadrant or at a portion of the first quadrant, in a case where, with the reference axis of the lens serving as an origin in a rear view, the first quadrant, the second quadrant, the third quadrant, and the fourth quadrant, divided by the vertical axis and the horizontal axis orthogonal to each other, passing through the origin, are defined.

9. The vehicle headlamp according to claim 6, wherein:

the semiconductor-type light source, the lens, the light shading member, and the prism member comprise:

a semiconductor-type light source, a lens, a light shading member, and a prism member for spot light distribution, which serve to implement spot light distribution at a substantially central portion on a screen light distribution of the light distribution pattern having the cutoff lines and the light distribution pattern for high beam; and a semiconductor-type light source, a lens, a light shading member, and a prism member for diffused light distribution, which serve to implement diffused light distribution of an entire portion on the screen light distribution of the light distribution pattern having the cutoff lines and the light distribution pattern for high beam.

10. The vehicle headlamp according to claim 9, wherein:

the cutoff lines are made of: an oblique cutoff line with an upward gradient from an elbow point to a cruising lane side; an upper horizontal cutoff line which is horizontal from the oblique cutoff line to the cruising lane side; and a lower horizontal cutoff line which is horizontal from the elbow point to an opposite lane side;

a long side of the light source of the semiconductor-type light source for spot light distribution is rotated by about 5 degrees, and is tilted with respect to the horizontal axis, so that the cruising lane side is upward than the opposite lane side with respect to the horizontal axis around the reference axis of the lens;

the long side of the light source of the semiconductor-type light source for diffused light distribution is parallel to the horizontal axis;

a projection image of the light source, which is emitted from the first quadrant and the fourth quadrant of the emission surface of a respective one of the lens for spot light distribution and the lens for diffused light distribution, forms a light distribution on the cruising lane side from the elbow point on the screen light distribution of the light distribution pattern having the cutoff lines; and a projection image of the light source, which is emitted from the second quadrant and the third quadrant of the emission surface of a respective one of the lens for spot light distribution and the lens for diffused light distribution, form a light distribution on the opposite lane side from the elbow point on the screen light distribution of the light distribution pattern having the cutoff lines.

11. The vehicle headlamp according to claim 6, wherein:

the prism member comprises:

a prism member for high beam, forming the light distribution pattern for high beam; and other one or more prism members for light distribution pattern, forming other one or more light distribution patterns, and the switching device is for replaceably switching the light shading member and the prism member for high beam, which is integrally structured, and said other one or more prism members for light distribution pattern, between a first location and a second location, thereby switching a current light distribution pattern to a light distribution pattern having one or more cutoff lines, a light distribution pattern for high beam, or alternatively, other one or more light distribution patterns.

* * * * *